US007748693B2

(12) United States Patent
Matsumoto

(10) Patent No.: US 7,748,693 B2
(45) Date of Patent: Jul. 6, 2010

(54) SHEET CARRYING DEVICE, DOCUMENT CARRYING DEVICE, IMAGE FORMING APPARATUS, AND SHEET CARRYING METHOD

(75) Inventor: Kazutaka Matsumoto, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 74 days.

(21) Appl. No.: 12/201,004

(22) Filed: Aug. 29, 2008

(65) Prior Publication Data

US 2009/0057987 A1 Mar. 5, 2009

(30) Foreign Application Priority Data

Sep. 4, 2007 (JP) ..... 2007-229563

(51) Int. Cl.
*B65H 5/00* (2006.01)

(52) U.S. Cl. ..... 271/10.03; 271/4.03; 271/10.11

(58) Field of Classification Search ..... 271/4.02, 271/4.03, 10.02, 10.03, 109, 110, 265.01, 271/265.02

See application file for complete search history.

(56) References Cited

U.S. PATENT DOCUMENTS

| | | | | |
|---|---|---|---|---|
| 6,508,465 | B1 * | 1/2003 | Endo | 271/265.01 |
| 7,308,853 | B2 * | 12/2007 | Satoh et al. | 101/118 |
| 7,396,009 | B2 * | 7/2008 | Elliott et al. | 271/10.03 |
| 2004/0217541 | A1 | 11/2004 | Horio | |
| 2005/0264636 | A1 | 12/2005 | Takito et al. | |

FOREIGN PATENT DOCUMENTS

| | | |
|---|---|---|
| JP | 07-251963 | 3/1995 |
| JP | 10-101238 | 4/1998 |
| JP | 2001-088958 | 4/2001 |
| JP | 2003-192156 | 7/2003 |
| JP | 2004-269256 | 9/2004 |
| JP | 2005-324931 | 11/2005 |

OTHER PUBLICATIONS

Tsuruoka et al.; "Basic Study on Traction Control of Electric Vehicle"; Transactions of Institute of Electrical Engineers of Japan; D, vol. 118-D, No. 1; pp. 45-50; 1998. Please note: Translation of article included. (cited on p. 4 of the specification). (previously submitted with application on Aug. 29, 2008).

Co-pending U.S. Appl. No. 12/201,054, filed Aug. 29, 2008 (application provided).

* cited by examiner

*Primary Examiner*—Kaitlin S Joerger
(74) *Attorney, Agent, or Firm*—Renner, Otto, Boisselle & Sklar, LLP

(57) ABSTRACT

A sheet carrying device includes a pickup roller sending out a sheet to a carrying path one by one from a document mounting tray, a roller first driving motor rotating the pickup roller, a control section controlling the roller first driving motor, and a slip detecting device detecting whether the pickup roller slips in an amount not less than a predetermined amount in carrying the sheet. Detecting that the pickup roller slips, the control section controls the roller first driving motor to perform a slip-settling operation for decreasing a start-up acceleration of the pickup roller from a time when starting to rotate to a time when reaching a predetermined speed. This allows reliably carrying a sheet and suppressing a decrease in a carrying speed of the sheet in order to prevent a decrease in a speed of a process including sheet carrying, even when the pickup roller slips in feeding the sheet from the sheet mounting tray.

11 Claims, 19 Drawing Sheets

FIG. 9

ACCELERATION TABLE

SMALL $\lambda$ ↓ LARGE $\lambda$

HIGH $\alpha$ ↓ LOW $\alpha$

| | TOTAL NUMBER OF DOCUMENTS CARRIED C | |
|---|---|---|
| | $\leqq 10000$ | $>10000$ |
| $\lambda 1$ | $\alpha 10$ | $\alpha 10$ |
| $\lambda 2$ | $\alpha 10$ | $\alpha 9$ |
| $\lambda 3$ | $\alpha 10$ | $\alpha 8$ |
| $\lambda 4$ | $\alpha 10$ | $\alpha 7$ |
| $\lambda 5$ | $\alpha 10$ | $\alpha 6$ |
| $\lambda 6$ | $\alpha 10$ | $\alpha 5$ |
| $\lambda 7$ | $\alpha 10$ | $\alpha 4$ |
| $\lambda 8$ | $\alpha 10$ | $\alpha 3$ |
| $\lambda 9$ | $\alpha 10$ | $\alpha 2$ |

(SPEED CONTROL BY SPEED CONTROLLER)

| | INCREASE IN NUMBER OF PULSES | MAXIMUM NUMBER OF PULSES |
|---|---|---|
| LOW ACCELERATION $\alpha 1$ | P1 | Pmax |
| INTERMEDIATE ACCELERATION $\alpha 2$ | P2 | Pmax |
| HIGH ACCELERATION $\alpha 3$ | P3 | Pmax |

P1<P2<P3

SHEET CARRYING DEVICE, DOCUMENT CARRYING DEVICE, IMAGE FORMING APPARATUS, AND SHEET CARRYING METHOD

This Nonprovisional application claims priority under U.S.C. §119(a) on Patent Application No. 229563/2007 filed in Japan on Sep. 4, 2007, the entire contents of which are hereby incorporated by reference.

FIELD OF THE INVENTION

The present invention is related to a sheet carrying device and a document carrying device that are provided in an image forming apparatus such as a digital copying machine, an image forming apparatus, and a sheet carrying method.

BACKGROUND OF THE INVENTION

A sheet carrying device is provided in an image forming apparatus, for example a digital copying machine. The sheet carrying device serves as an automatic document carrying device in a case where a document is carried, and serves as a paper feeding device including a paper feeding cassette in a case where printing paper is carried.

In such a sheet carrying device, a sheet is picked up one by one by a pickup roller, from a tray on which sheets such as documents or paper are mounted. Thus picked-up sheet is carried by use of a plurality of pairs of carrying rollers.

Here, the sheet carrying device is required to appropriately carry various types of papers as a result of (i) diversification of document paper types and (ii) use of printing paper suitable for color photocopying, so that no malfunction such as jamming of paper occurs in paper carrying. Moreover, image forming apparatuses are required to accelerate a speed of a printing process. High-speed carrying is essential for satisfying this requirement.

The sheet carrying device has the following problem in satisfying the aforementioned requirements. For example, when various sheets are to be carried, a frictional force between sheets or between the sheet and the pickup roller is not constant, depending on a type of each sheet. Usually, the frictional force differs between the types of sheets. Moreover, the pickup roller deteriorates over time, and is contaminated by, for example, adhesion of paper powder and/or oil. Due to these circumstances, the pickup roller may slip on the sheet when the sheet is picked up from the tray. Slipping on the sheet, the pickup roller cannot carry the sheet to a predetermined carrying destination within a predetermined time. Therefore, a high speed process becomes difficult in a printing process in the image forming apparatus.

On the other hand, when the slip occurs, the pickup roller retries a paper feeding operation. However, under the condition in which the slip of the pickup roller has occurred, there are cases in which it is difficult to feed the sheet by a simple retry.

In view of the above problem, in Patent Document 1, when a slip has occurred, a pickup roller retries a paper feeding operation at a decreased rotation speed (decreased maximum speed) of the pickup roller.

[Patent Document 1]

Japanese Unexamined Patent Publication No. 269256/2004 (Tokukai 2004-269256) (published on Sep. 30, 2004)

[Non-Patent Document 1]

Yoshimasa Tsuruoka, Yasushi Toyoda, and Yoichi Hori, "Basic Study on Traction Control of Electric Vehicle", Transactions of Institute of Electrical Engineers of Japan: D, Vol. 118-D, No. 1, pp 45-50, 1998.1.

However, in the arrangement of Patent Document 1, although feeding of the sheet becomes possible by carrying out the retry at a decreased rotation speed (decreased maximum speed) of the pickup roller, a carrying speed of the sheet slows down because of a continuing state in which a rotation speed of the sheet is decreased by the pickup roller. Therefore, the requirement of high speed processing is not satisfied in the image forming apparatus.

SUMMARY OF THE INVENTION

Therefore, an object of the present invention is to provide a sheet carrying device, a document carrying device, an image forming apparatus, and a sheet carrying method, each of which allows (i) reliably carrying a sheet, and (ii) suppressing a decrease in a carrying speed of the sheet in order to prevent a decrease in a speed of a process including sheet carrying, even in a case where a paper feeding roller slips on a sheet in an arrangement in which a sheet is fed by a paper feeding roller from a sheet mounting tray.

A sheet carrying device of the present invention includes: a paper feeding roller sending out a sheet to a carrying path one by one from a sheet mounting tray; a roller driving device for rotating the paper feeding roller; a control section for controlling of the roller driving device to rotate the paper feeding roller; and the sheet carrying device including a slip detecting device for detecting whether or not a slip of the paper feeding roller occurs in an amount equal to or more than a predetermined amount when the sheet is carried, the control section controlling the roller driving device so as to perform a slip-settling operation which decreases a start-up acceleration of the paper feeding roller when the slip detecting device detects that a slip of the paper feeding roller occurs in an amount equal to or more than the predetermined amount, the start-up acceleration being an acceleration from a time when the paper feeding roller starts to rotate to a time when the paper feeding roller reaches a predetermined speed.

A sheet carrying method for sending out a sheet to a carrying path one by one from a sheet mounting tray by use of a paper feeding roller, includes: performing a slip-settling operation for decreasing a start-up acceleration of the paper feeding roller when a slip of the paper feeding roller occurs in an amount equal to or more than a predetermined amount in carrying the document, the start-up acceleration being an acceleration from a time when the paper feeding roller starts to rotate to a time when the paper feeding roller reaches a predetermined speed.

According to the arrangement, in the case where a slip of the paper feeding roller occurs in an amount equal to or more than a predetermined amount, a start-up acceleration is decreased. The start-up acceleration is acceleration of the paper feeding roller from a time when the paper feeding roller starts to rotate to a time when the paper feeding roller reaches a predetermined speed in the rotation. Therefore, it is possible to suppress a slip of the paper feeding roller on the sheet, for example, a slip caused by abrasion of the paper feeding roller and/or contamination of the paper feeding roller, and reliably send out a sheet from a sheet mounting tray by the paper feeding roller. In this case, although the paper feeding roller has a decreased start-up acceleration before arrival at a predetermined speed, a maximum speed (predetermined speed) is kept after the start-up. Therefore, a decrease in a carrying speed of the sheet is suppressed.

Namely, according to the present invention, even in a case where a slip of a paper feeding roller on a sheet has occurred, it is possible to (i) reliably carry a sheet, and (ii) prevent a decrease in a speed of a process including sheet carrying, by suppressing a decrease in a speed of the sheet carrying.

BRIEF DESCRIPTION OF THE DRAWINGS

FIG. 9 is an explanatory diagram illustrating an acceleration table used in controlling a pickup roller by the document carrying control section illustrated in FIG. 8.

FIG. 11(*b*) is a graph illustrating a relationship between a time period and the number of pulses that are outputted from the speed controller.

DESCRIPTION OF THE EMBODIMENTS

First Embodiment

The following explanation describes one embodiment of the present invention with reference to drawings.

(Explanation of Operations of Image Forming Apparatus)

Figure 1:
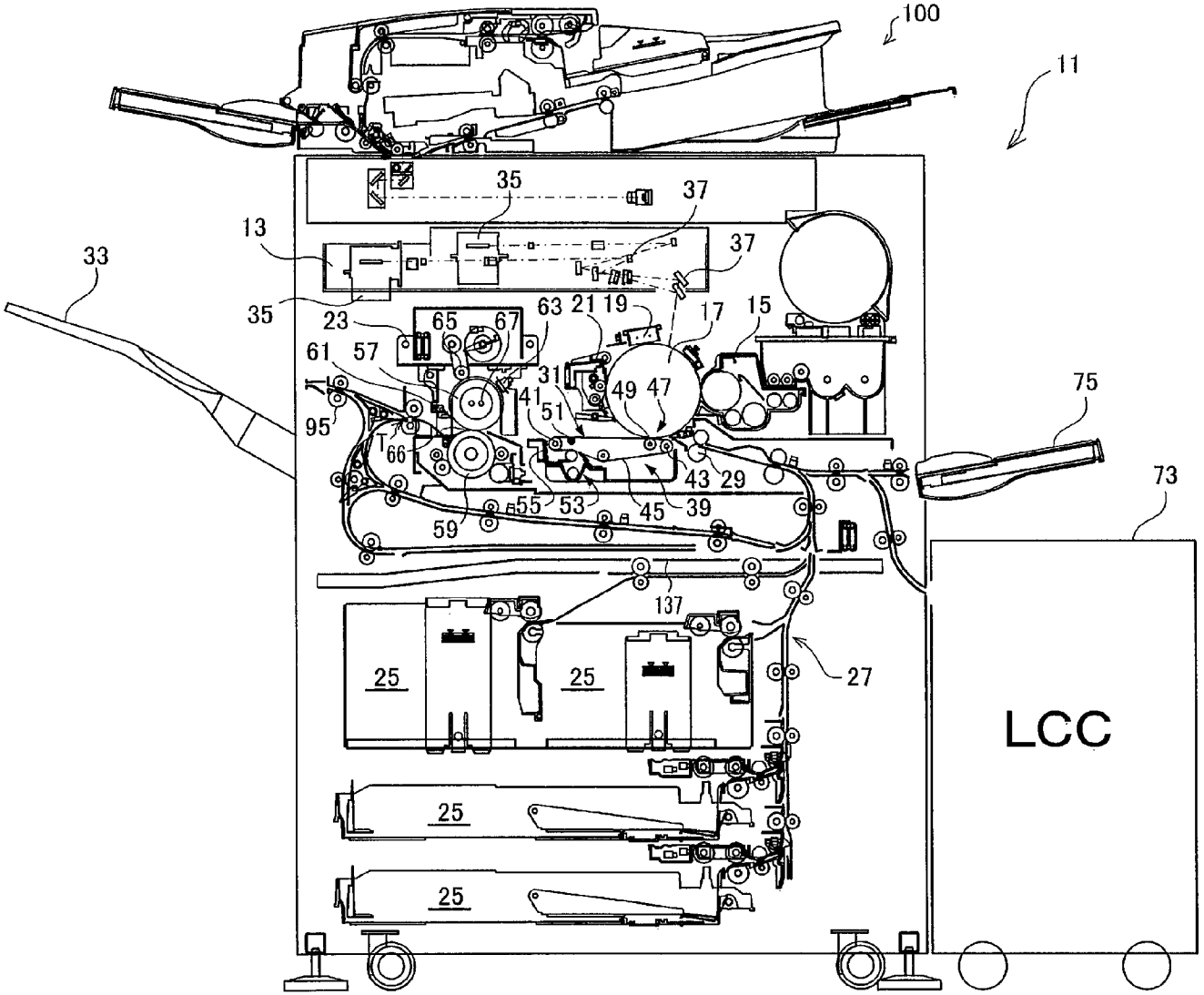
FIG. 1 is an explanatory diagram illustrating an arrangement of an image forming apparatus including a sheet carrying device of one embodiment according to the present invention.

FIG. 1 is an explanatory diagram illustrating an arrangement of an image forming apparatus 11 according to the present embodiment. The image forming apparatus 11 is, for example a digital copying machine, and forms a monochrome image on a predetermined sheet (recording paper) in accordance with image data that is received from outside.

As illustrated in FIG. 1, the image forming apparatus 11 includes means such as an exposure unit 13, a developing device 15, a photoreceptor 17, a charging device 19, a cleaner unit 21, a fixing unit 23, a paper feeding tray 25, a paper feeding carrying path 27 which extends upwards from the paper feeding tray 25, a paper carrying path 31 starting from an end of the paper feeding carrying path 27 to a paper output roller 95 via a registration roller 29, a transfer belt 45 and the fixing unit 23, and a paper output tray 33. The image forming apparatus 11 also includes a transfer mechanism 39.

A charging device 19 uniformly charges a surface of a drum of the photoreceptor 17 to a predetermined electric potential. The charging device 19 is of a corona discharge type in the present embodiment. However, the charging device 19 may be of a contact type, in a roller shape or a brush shape.

The exposure unit 13 in the present embodiment carries out exposure by use of a laser scanning unit (LSU) that includes a laser irradiation section 35 and a reflection mirror 37. Other than this, the exposure unit 13 may carry out exposure by use of, for example, an EL or LED writing head in which light emitting elements are arranged in an array. The image forming apparatus 11 adopts a two-beam method in order to carry out a high speed printing process. The two-beam method is a method which inhibits acceleration of irradiation timing by use of a plurality of laser beams. The exposure unit 13 has a function of forming, on a surface of the photoreceptor 17, an electrostatic latent image corresponding to inputted image data, by exposing, in accordance with the inputted image data, the photoreceptor 17 that is uniformly charged by the charging device 19.

The developing device 15 makes the electrostatic latent image visible with the use of toner which electrostatic latent image is formed on the photoreceptor 17. The cleaner unit 21 removes and collects residual toner on a surface of the photoreceptor 17 after development and transfer of the image.

The transfer mechanism 39 transfers the toner that makes the image visible on the photoreceptor 17 to paper that is carried via the paper carrying path 31. The transfer mechanism 39 is constructed of a transfer belt unit in the present embodiment, and is a mechanism for transferring the toner to the paper by application of an electric field that is a reversed polarity of an electric charge of the toner. For example, when an electrostatic latent image has an electric charge of a (−) polarity, a polarity to be applied to the transfer mechanism 39 is a (+) polarity.

The transfer mechanism 39 includes the transfer belt 45. The transfer belt 45 is suspended by a drive roller 41, a driven roller 43 and other rollers. The transfer belt 45 has a predetermined resistance (in a range of $1\times10^{9}$ Ω·cm to $1\times10^{13}$ Ω·cm).

The drive roller 41, the driven roller 43, and an elastic conductive roller 49 on which a transfer electric field can be applied are provided at a contact section 47 where the photoreceptor 17 and the transfer belt 45 are in contact with each other. Because the elastic conductive roller 49 is elastic, the photoreceptor 17 and the transfer belt 45 have not a line contact but a plane contact with each other for a predetermined width (referred to as a transfer nip). This improves transfer efficiency of the toner to the carried paper.

A charge removing roller 51 is provided on a back side of the transfer belt 45 on a downstream side of a transfer area of the transfer belt 45. The charge removing roller 51 removes an electric charge from charged paper which is charged by a voltage that is applied to the contact section 47 at the time when the paper passes through the contact section 47, in order to smoothly carry out the carrying of the paper to the next step.

Furthermore, the transfer mechanism 39 includes a cleaning unit 53, which cleans toner on the transfer belt 45, and a charge removing mechanism 55, which removes an electric charge from the transfer belt 45. A method for removing an electric charge by the charge removing mechanism 55 may be a method in which the transfer mechanism 39 is grounded via the image forming apparatus 11, or a method in which an electric field of a reverse polarity with respect to a polarity of the transfer electric field is actively applied to the transfer mechanism 39. The paper on which the toner is transferred at the transfer mechanism 39 is carried to the fixing unit 23.

The fixing unit 23 includes a heating roller 57 and a pressure roller 59. A paper separating claw 61, a roller surface temperature detecting member 63 (thermistor), and a roller surface cleaning member 65 are provided to an outer periphery section of the heating roller 57. A heat source 67 for heating a surface of the roller to a predetermined temperature (set temperature for fixing: in a range of approximately 160° C. to 200° C.) is provided to an inner periphery section of the heating roller 57.

Each of both ends of the pressure roller 59 is provided with a pressing member that allows the pressure roller 59 to have contact with the heating roller 57 at a predetermined pressure. Similar to the outer periphery section of the heating roller 57, a paper separating claw 61 and a roller surface cleaning member 65 are provided to an outer periphery section of the pressure roller 59.

At a contact section (referred to as a fixing nip section) of the heating roller 57 and the pressure roller 59 that press against each other, the fixing unit 23 (i) heats and melts unfixed toner on the carried paper by a surface temperature of the heating roller 57, and (ii) fixes the unfixed toner on the paper by causing the toner to interlock with paper fiber with the use of a pressure that is applied on the unfixed toner and the sheet by the pressure roller 59.

The paper feeding tray 25 stocks sheets (recording paper) to be used for image formation, and is provided under the image forming section and on a side wall of the image forming section, where printing on the paper is carried out. In the image forming apparatus 11, each paper feeding tray 25 that is provided under the image forming section is capable of storing 500 to 1500 standard size sheets. A side wall of the image forming apparatus 11 is provided with (i) a mass storage paper feeding cassette 73 capable of storing a mass of sheets of a plurality of types, and (ii) a manual feed tray 75 which is mainly used for feeding paper in printing on non-standardized size paper.

The paper output tray 33 is provided on a side wall opposite to the side wall provided with the manual feed tray 75 in the image forming apparatus 11. The image forming apparatus 11 may include, as an option, a subsequent process device for the outputted paper (e.g., stapling and punching processes), or a paper output tray having a plurality of shelves, instead of the paper output tray 33.

The image forming apparatus 11 includes a control section (not illustrated). The control section controls operations of the image forming apparatus 11, and is constructed of, for example, a CPU, a ROM, a RAM, a nonvolatile memory, an input circuit, and an output circuit. The ROM stores a control program which indicates procedures of processes that are to be executed by the CPU. The RAM provides a work area for use in operations. The nonvolatile memory makes a backup of data necessary for control and stores the backup of the data. The input circuit receives input signals from sensors and switches, and includes an input buffer and an A/D conversion circuit. The output circuit includes a driver for driving a load such as a motor, a solenoid, and a lamp.

The following description explains in detail paper carrying steps corresponding to a process mode of the image forming apparatus 11. The paper carrying steps are carried out under the control of the control section.

First, a sheet of paper which fits in with a printing requirement is selected from the plurality of paper feed trays 25, and is carried to the registration roller 29 via a carrying roller in a carrying path. The sheet once stops at a position where the sheet has reached the registration roller 29.

Next, the registration roller 29 rotates at timing at which a front end of the sheet and image information on the photoreceptor 17 match. This carries the sheet to the transfer mechanism 39. In the transfer mechanism 39, a toner corresponding to the image information is transferred to the sheet. Subsequently, the sheet is carried to the fixing unit 23 and the toner transferred to the sheet is fixed on the sheet. The sheet is then outputted to the paper output tray 33.

The control section controls a carrying method of the sheet from the fixing unit 23 to the paper output tray 33, in accordance with a printing mode (e.g., copy mode, printer mode, or FAX mode) and a printing processing method (e.g., single-sided printing/double-sided printing).

In a regular copy mode, paper carrying is often controlled so as to output a printed sheet having a printed side facing upwards. This is because a user operates the apparatus in a position close to the apparatus in the regular copy mode. This output method is called "face-up output". On the other hand, each of the printer and FAX modes often utilizes "face-down output" in which the outputted sheets are put into page order. This is because the user is not close to the apparatus in each of the printer and FAX modes.

Therefore, the image forming apparatus 11 has a mechanism capable of switching the face-up output to the face-down output or vice versa, in accordance with the printing mode. This switching mechanism has a plurality of carrying paths and a plurality of diverging claws that are provided in a paper carrying path between a position at which a sheet passes through the fixing unit 23 and a position at which the sheet is outputted to the paper output tray 33. This allows the sheet which has been subjected to fixing to be outputted to the paper output tray 33 in accordance with the printing mode.

(Outline of Document Scanning Apparatus)

Figure 2:
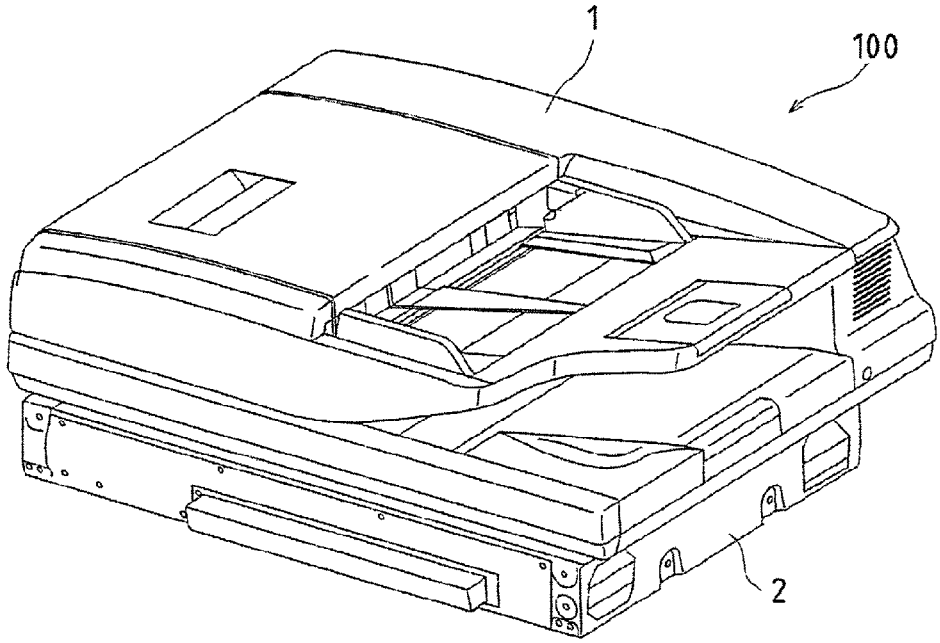
FIG. 2 is a perspective view illustrating an external view of a document scanning apparatus including a sheet carrying device in one embodiment of the present invention.
Figure 3:
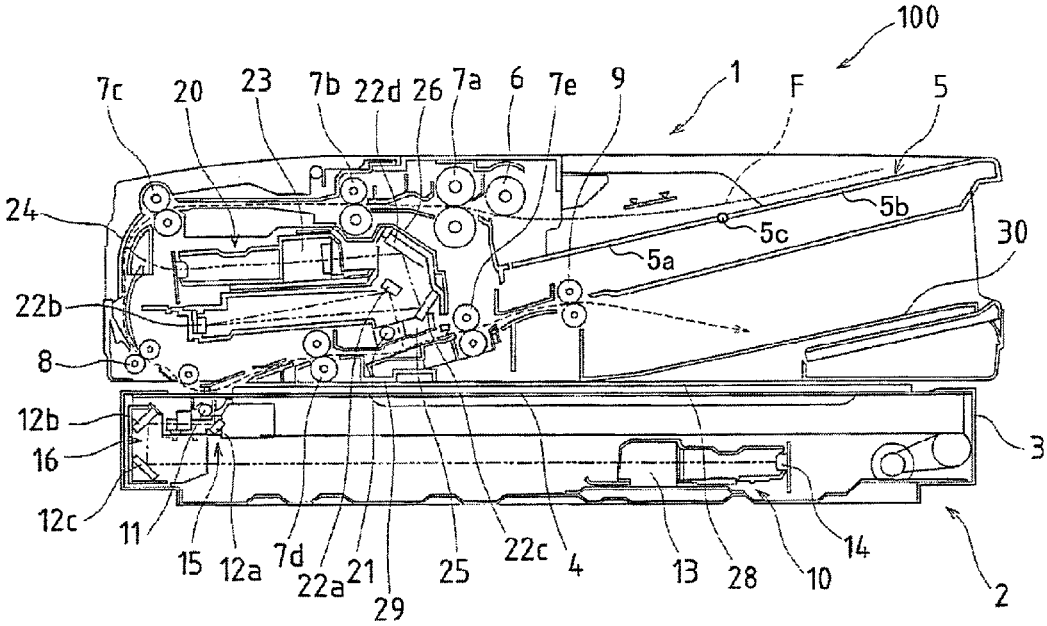
FIG. 3 is a longitudinal sectional view schematically illustrating the document scanning apparatus illustrated in FIG. 2.

FIG. 2 is a perspective view illustrating an external view of a document scanning apparatus 100 including a sheet carrying device according to one embodiment of the present invention. FIG. 3 is a longitudinal sectional view schematically illustrating the document scanning apparatus 100 illustrated in FIG. 2.

As illustrated in FIG. 3, the document scanning apparatus 100 includes an automatic document feeder (hereinafter, referred to as ADF) 1, a first image scanning device 10, and a second image scanning device 20. The ADF 1 automatically carries a document through a document carrying path F. The first image scanning device 10 scans an image on a front surface side of thus carried document. The second image scanning device 20 scans an image on a rear surface side of the carried document.

The first image scanning device 10 includes image scanning means of an optical reduction system which image scanning means includes a light source 11, first to third mirrors 12*a* through 12*c*, a lens 13, and a CCD (image sensor) 14. The second image scanning device 20 includes image scanning means of an optical reduction system which image scanning means includes a light source 21, first to fourth mirrors 22*a* through 22*d*, a lens 23, and a CCD (image sensor) 24.

The document scanning apparatus 100 is provided on the image forming apparatus 11, and is mainly composed of the ADF 1 including the second image scanning device 20, and a main scanning section 2 including the first image scanning device 10. The ADF 1 and the main scanning section 2 are joined by a hinge (not illustrated). The ADF 1 can be opened/closed with respect to the main scanning section 2 by turning of the hinge.

The main scanning section 2 is mainly composed of a housing 3, a platen 4 that is made of a transparent glass plate, and the first image scanning device 10 that is included in the housing 3. The first image scanning device 10 includes a light source unit 15 that includes the light source 11 and the first mirror 12*a*, a mirror unit 16 that includes the second mirror 12*b* and the third mirror 12*c*, the lens 13, and the CCD 14.

The main scanning section 2 deals with both image scanning methods including (i) a stationary document scanning method in which a document image is scanned from a document having been placed by a user on the platen 4 and (ii) a moving document scanning method in which a document image is scanned from a document that is being automatically carried by the ADF 1.

In the case of scanning a document image by the stationary document scanning method, the light source unit 15 and the mirror unit 16 move to respective home positions corresponding to the stationary document scanning method. Then, irradiating light with respect to a document, the light source unit 15 moves at a constant speed in a sub-scanning direction (a left-right direction with respect to a sheet surface) so as to scan the document image. Simultaneously, the mirror unit 16 moves in the sub-scanning direction at a movement speed that is a half of the movement speed of the light source unit 15.

The light that is irradiated from the light source unit 15 and reflected by the document is further reflected by the first mirror 12*a* that is provided in the light source unit 15. Then, a light path of thus reflected light is changed by 180° by the second and third mirrors 12*b* and 12*c* of the mirror unit 16, and an image is formed on the CCD 14 via the lens 13. Finally, thus formed image is converted into electronic image data.

On the other hand, in the case of scanning a document image by the moving document scanning method, the light source unit 15 and the mirror unit 16 stay still at respective home positions illustrated in FIG. 3, and scan an image by irradiating light from the light source 11 with respect to a document. While the image is scanned, the document is being carried by the ADF 1 so as to pass above the respective home positions. Light that is reflected from a front surface side of the document is reflected by the first mirror 12*a*, as in the stationary document scanning method. Then, a light path of thus reflected light is changed by 180° by the second and third mirrors 12*b* and 12*c* of the mirror unit 16, and an image is formed on the CCD 14 via the lens 13. Finally, thus formed image is converted into electronic image data.

The ADF 1 includes a pickup roller 6, a plurality of pairs of carrying rollers 7 (7*a* through 7*e*), a registration roller 8, and a paper output roller 9. Moreover, the second image scanning device 20 that is unitized is provided within the document carrying path F in an arc of substantially a letter U shape. The pickup roller 6 takes, into the ADF 1, a document that is on the document mounting tray 5 one sheet at a time. In this case, the pickup roller 6 is once stopped every time feeding of one sheet of the document completes. Then, the pickup roller 6 is started when feeding of a next sheet of the document starts.

The carrying rollers 7 carry the document that is taken in by the pickup roller 6 through the document carrying path F. The registration roller 8 adjusts sheet feed timing.

The second image scanning device 20 is unitized, by arranging a unit housing 26 to contain, as one aggregate, members including a light source holder 25 including the light source 21, the first to fourth mirrors 22*a* through 22*d*, the lens 23, and the CCD 24. Note that the light source 21 included in the light source holder 25, the lens 23, and the CCD 24 in the second image scanning device 20 are the same as those constituting the first image scanning device 10.

The second image scanning device 20 scans an image on the rear surface side of the document that is carried through the document carrying path F, when a user makes a request for scanning both sides. Specifically, after the image on the front surface side of the document is scanned by the first image scanning device 10, the document passes below the light source holder 25 of the second image scanning device 20 at the time when the document is carried towards an output tray 30 through the document carrying path F. When the document passes below the second image scanning device 20, the light source 21 irradiates light to a rear surface side of the document, and light is reflected from the rear surface side of the document. A light path of thus reflected light is changed by each of the first to fourth mirrors 22*a* through 22*d* by turns. Then, an image is formed on the CCD 24 via the lens 23. Finally, thus formed image is converted into electronic image data.

An undersurface of the ADF 1 is a document pressing board 28 for pressing, from above, a document that is placed on the platen 4 of the main scanning section 2 and to be scanned. This document pressing board 28 has an openable cover 29, which is a section facing the light source holder 25 of the second image scanning device 20.

The document mounting tray 5 is made of a document lifting plate 5*a* on a downstream side in a paper feeding direction and a fixed plate 5*b* on an upstream side in the paper feeding direction. The document lifting plate 5*a* and the fixed plate 5*b* are joined by a hinge 5*c*. The document lifting plate 5*a* can turn upward and downward around the hinge 5*c* at the center.

Figure 4:
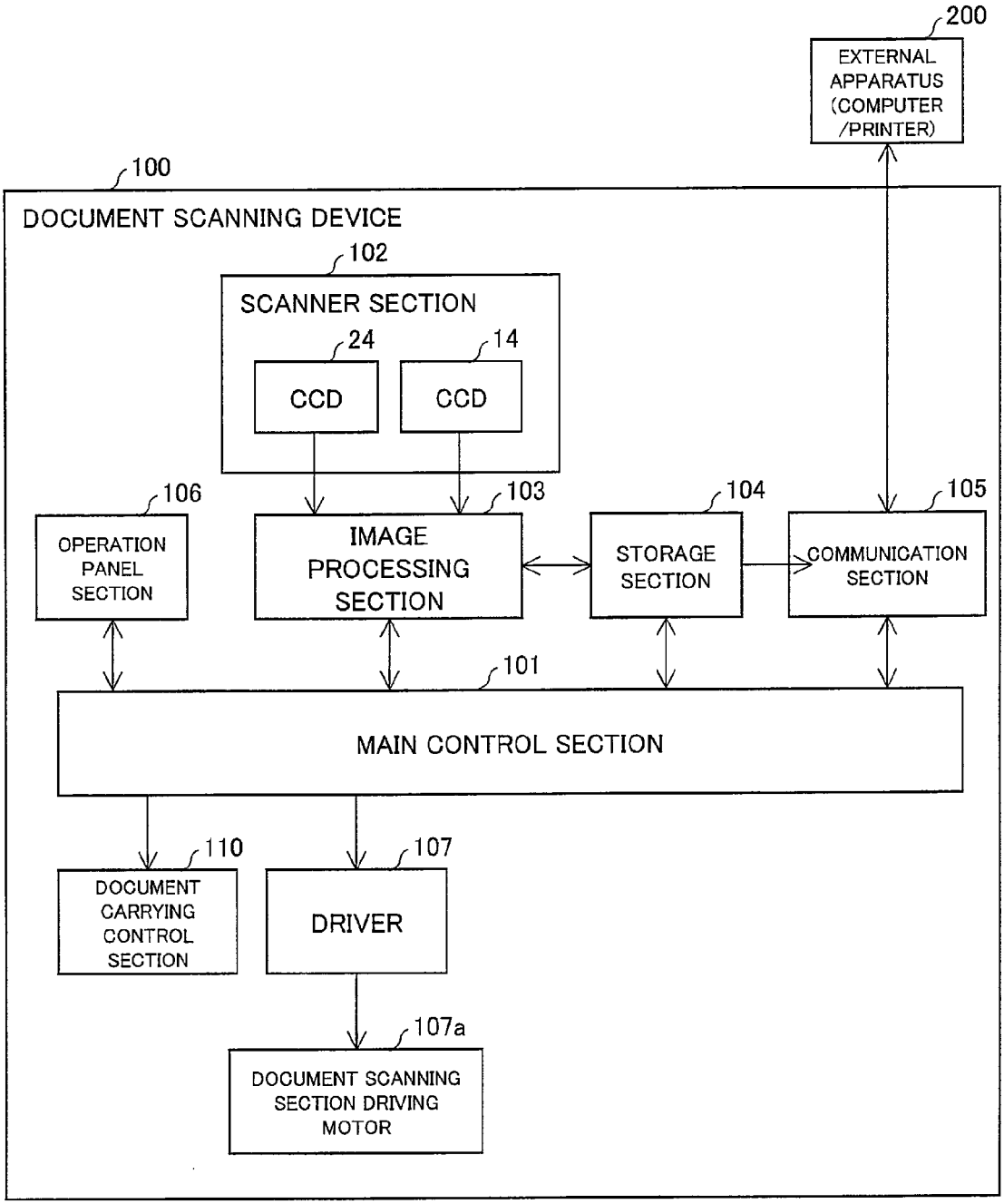
FIG. 4 is a block diagram schematically illustrating a main part of an electric configuration of a document scanning apparatus in one embodiment of the present invention.

FIG. 4 is a block diagram schematically illustrating a main part of an electric configuration of the document scanning apparatus 100 in the present embodiment.

As illustrated in FIG. 4, the document scanning apparatus 100 includes a main control section 101, a scanner section 102, an image processing section 103, a storage section 104, a communication section 105, an operation panel section 106, a driver 107 that controls a drive of a document scanning section driving motor 107*a*, and a document carrying control section (control section, determining section) 110.

The main control section 101 is a section that controls an operation control of a whole apparatus, and is made of, for example, a CPU, a ROM, or a RAM (not illustrated).

The scanner section 102 constitutes an optical scanning system of the first and second image scanning devices 10 and 20 shown in FIG. 3. In the above explanation, each of the CCD 14 of the first image scanning device 10 and the CCD 24 of the second image scanning device 20 is made of a CCD (Charge Coupled Device) of an optical reduction system, but may be made of a CIS (Contact Image Sensor) of a one-to-one magnification optical system.

The image processing section 103 converts, for each page unit, optical data that is scanned by the first image scanning device 10 or the second image scanning device 20 into electronic image data.

The storage section 104 is composed of, for example, a RAM, an EEPROM, a hard disk, or an MO, and stores data that is used in a control operation of the main control section 101, various instructions that are inputted, or the like. Moreover, the storage section 104 includes an area that serves as a document image storage section storing a document image that is scanned by the scanner section 102 and an area that serves as a document text storage section for storing a document text that is made of codes of converted character strings.

The communication section 105 is a communication section that carries out two-way communications between the image scanning apparatus 100 and an external apparatus 200 such as a computer or a printer that is connected to the image scanning apparatus 100. Moreover, the communication section 105 transmits, to the external apparatus 200, data that has been subjected to image processing at the image processing section 103. Further, the communication section 105 includes a memory for developing data that is received from the external apparatus 200 into data which the image forming apparatus 11 can deal with.

The operation panel section 106 is not illustrated in the drawings, but is provided to a near side of the document scanning apparatus 100 as illustrated in FIG. 2 in a paper depth direction. Specifically, the main scanning section 2 is extended from the ADF 1 to a near side with respect to the paper depth direction, and the operation panel section 106 is provided on an upper surface section of thus extended section. The operation panel section 106 is used, for example, when an operation mode (designation of single-sided scanning or double-sided scanning) at the time of scanning a document is inputted.

The document scanning section driving motor 107*a* is a motor to move the light source unit 15 and the mirror unit 16 at an appropriate speed in a sub-scanning direction, when a document image is scanned by a stationary document scanning method. The drive of the document scanning section driving motor 107*a* is controlled by the driver 107 as appropriate according to the control of the main control section 101.

The document carrying control section 110 controls drives of rollers including the pickup roller 6, the carrying rollers 7, the registration rollers 8, and the paper output rollers 9 that are provided in the document carrying path F, and a position of the document lifting plate 5*a* of the document mounting tray 5. Moreover, the document carrying control section 110 functions as various counters as later described.

(Main Part of Document Scanning Apparatus)

Figure 5:
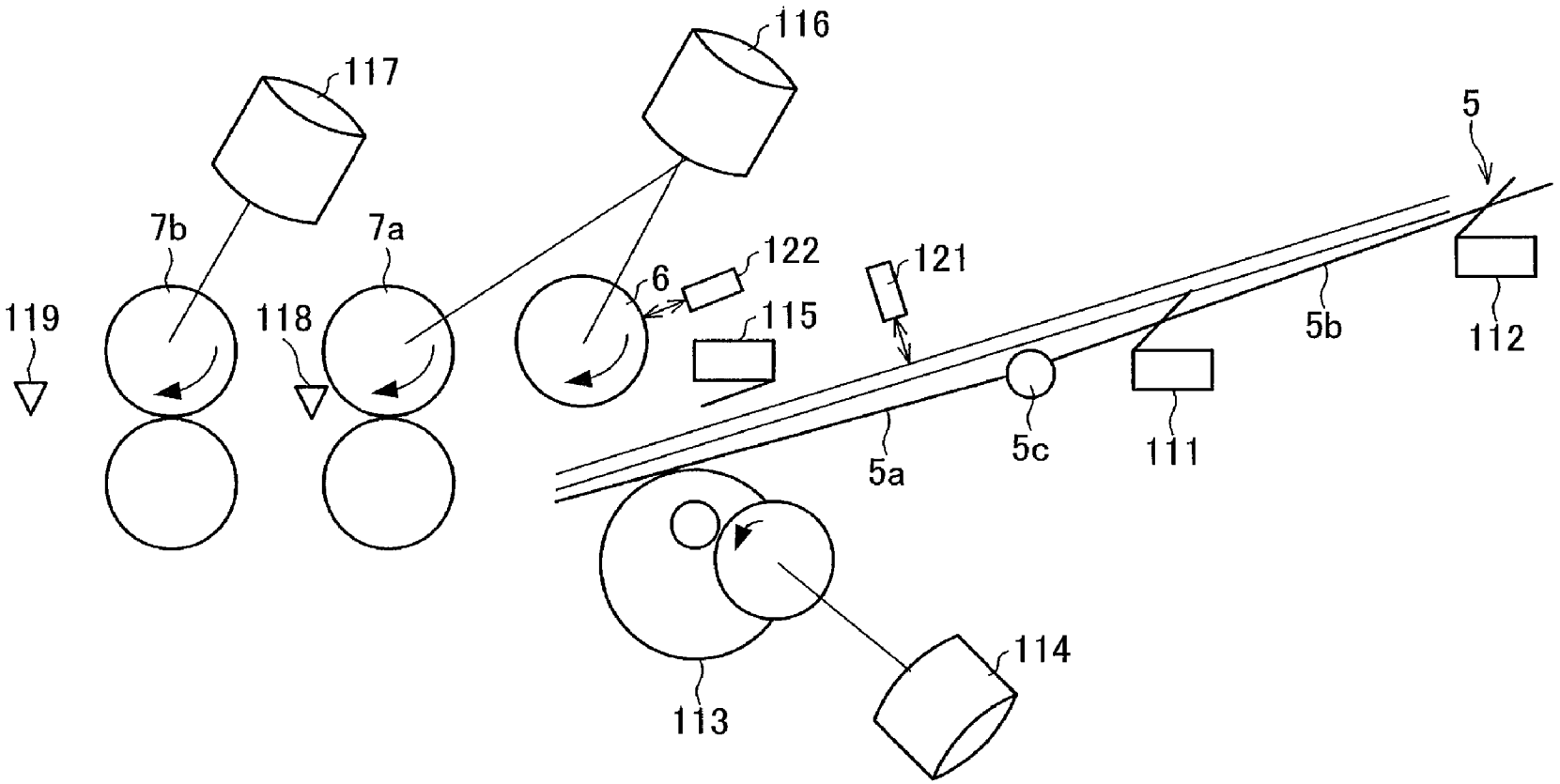
FIG. 5 is a diagram schematically illustrating an arrangement in the vicinity of a document mounting tray in the document scanning apparatus illustrated in FIG. 3, and illustrates a state that is immediately after placement of a document on the document mounting tray in the document scanning apparatus on standby.

FIG. 5 is a diagram schematically illustrating an arrangement in the vicinity of the document mounting tray 5 of the document scanning apparatus 100. FIG. 5 illustrates a state that is immediately after placement of a document on the document mounting tray 5 in the document scanning apparatus 100 on standby (a state before start of document feeding).

As illustrated in FIG. 5, an undersurface of the fixed plate 5*b* of the document mounting tray 5 is provided with a document-tray first document sensor 111 and a document-tray second document sensor 112 that are provided side by side in a document carrying direction. The document-tray first document sensor 111 is positioned on a downstream side in the document carrying direction and the document-tray second document sensor 112 is positioned on an upstream side in the document carrying direction.

The document-tray first document sensor 111 and the document-tray second document sensor 112 have respective detecting portions protruding from the fixed plate 5*b*. This allows detection of presence of a document D on the document mounting tray 5 and a document size, of the document D. That is, in a state where a document D is placed on the document mounting tray 5, the document D is a small sized document in a case where only the document-tray first document sensor 111 is detecting the document D. Meanwhile, the document D is a large sized document in a case where both of the document-tray first document sensor 111 and the document-tray second document sensor 112 are detecting the document D.

Under the document lifting plate 5*a*, an eccentric cam 113 is provided. An outer periphery surface of the eccentric cam 113 touches the undersurface of the document lifting plate 5*a*, and the eccentric cam 113 is driven by a cam driving motor 114 so as to rotate. When the eccentric cam 113 rotates, the document lifting plate 5*a* turns upward and downward around the hinge 5*c* at the center. Due to upward turning of the document lifting plate 5*a*, a document on the document lifting plate 5*a* comes into contact with the pickup roller 6. This allows the pickup roller 6 to take in the document. This state is detected by an upper surface detecting sensor 115.

Accordingly, the main control section 101 rotates the cam driving motor 114 until the upper surface detecting sensor 115 detects an upper surface of a document, when the document is fed from the document mounting tray 5. Meanwhile, the main control section 101 rotates the cam driving motor 114 so that the document lifting plate 5*a* turns downward to an initial position, when the feeding of the document from the document mounting tray 5 completes.

The document on the document mounting tray 5 is taken in by the pickup roller 6 from the document mounting tray 5 to the document scanning apparatus 100. Further, the document is carried by the carrying rollers 7*a* and 7*b* into the document scanning apparatus 100. Among the rollers, the pickup roller 6 and the carrying rollers 7*a* are driven by a roller first driving motor 116 and the carrying rollers 7*b* is driven by a roller second driving motor 117.

A carrying-path first document sensor 118 (slip detecting device) is provided in a position between the carrying rollers 7*a* and 7*b* on a downstream side of the carrying rollers 7*a* in the document carrying direction. A carrying-path second document sensor 119 is provided in a position between the carrying rollers 7*b* and the carrying rollers 7*c* (See FIG. 3) on a downstream side of the carrying roller 7*b* in the document carrying direction. The carrying-path first document sensor 118 and the carrying-path second document sensor 119 detect presence of a document in the document carrying path F.

Figure 6:
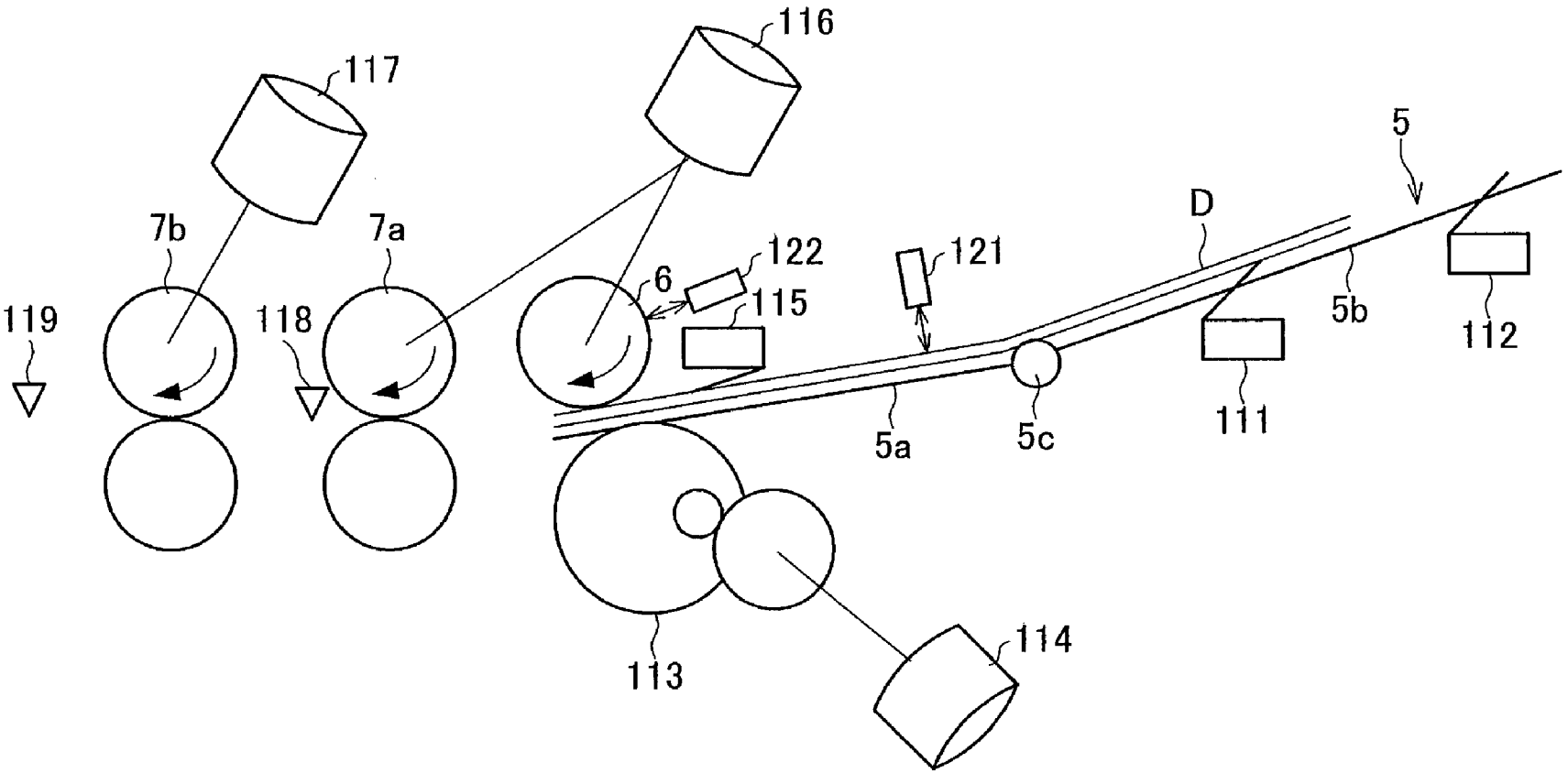
FIG. 6 is a diagram schematically illustrating an arrangement in the vicinity of the document mounting tray in the document scanning apparatus illustrated in FIG. 3, and illustrates a state in which (i) a document lifting plate rises from the state of FIG. 5, causing an upper surface of the document to have contact with a pickup roller, and (ii) the pickup roller and carrying rollers rotate so as to carry the document.

FIG. 6 is a diagram schematically illustrating an arrangement in the vicinity of the document mounting tray 5 in the document scanning apparatus 100, and illustrates a state in which (i) the document lifting plate 5*a* rises from the state of FIG. 5, causing an upper surface of the document to come into contact with the pickup roller 6, and (ii) the pickup roller 6 and the carrying rollers 7*a* and 7*b* rotate so as to carry the document.

Figure 7:
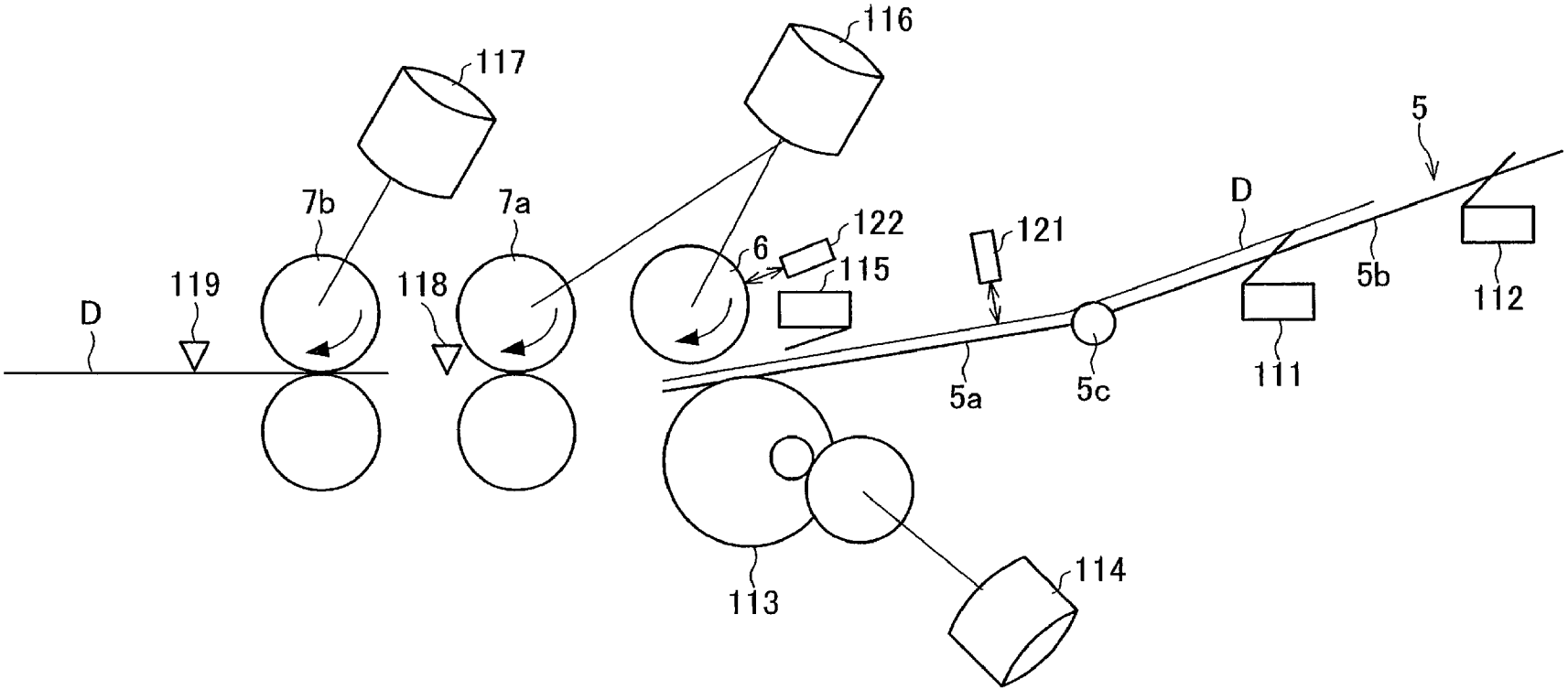
FIG. 7 is a diagram schematically illustrating an arrangement in the vicinity of the document mounting tray in the document scanning apparatus illustrated in FIG. 3, and illustrates a state (i) in which a rear end of a first document has passed a carrying-path first document sensor, from the state illustrated in FIG. 6, and a pickup roller has stopped rotating and (ii) the pickup roller has not started rotation for a next document.

FIG. 7 is a diagram schematically illustrating an arrangement in the vicinity of the document mounting tray 5 in the document scanning apparatus 100, and illustrates a state (i) in which a rear end of a first document has passed the carrying-path first document sensor 118, from the state illustrated in FIG. 6, and the pickup roller 6 has stopped rotating and (ii) the pickup roller 6 has not started rotation for a next document yet.

Figure 8:
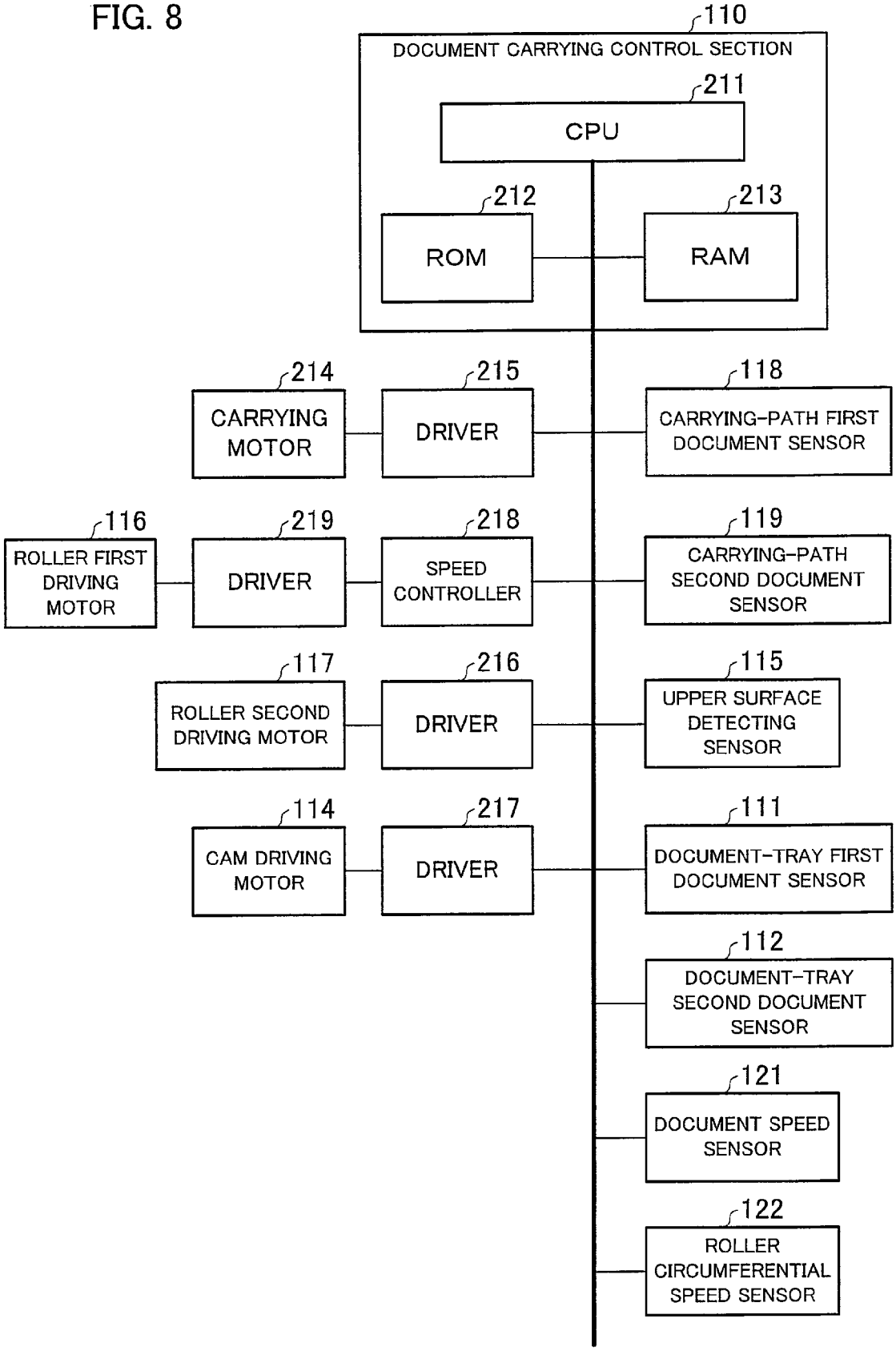
FIG. 8 is a block diagram illustrating a document carrying control section shown in FIG. 4, and sections that are controlled by the document carrying control section.

FIG. 8 is a block diagram illustrating a document carrying control section 110 shown in FIG. 4, and sections that are controlled by the document carrying control section 110.

The document carrying control section (control section) 110 includes a CPU 211, a ROM 212, and a RAM 213. The ROM 212 stores a program to cause the CPU 211 to control each section.

The document carrying control section 110 is connected with the carrying-path first document sensor 118, the carrying-path second document sensor 119, the upper surface detecting sensor 115, the document-tray first document sensor 111, the document-tray second document sensor 112, drivers 215 through 217, a speed controller (control section) 218, a document speed sensor 121, and a roller circumferential speed sensor 122.

The driver 215 drives a carrying motor 214. This carrying motor 214 carries a document through the document carrying path F, and includes a motor other than the roller first driving motor 116 and the roller second driving motor 117. The driver 216 drives the roller second driving motor 117. The driver 217 drives the cam driving motor 114.

The speed controller 218 controls respective rotation speeds of the roller first driving motor 116 and the carrying roller 7*a*, by controlling the driver 219 that drives the roller first driving motor 116.

The document speed sensor 121 detects a carrying speed (document speed) of a document on the document mounting tray 5 that is carried by the pickup roller 6. The roller circumferential speed sensor 122 detects a circumferential speed of the pickup roller 6. The document speed sensor 121 and the roller circumferential speed sensor 122 employ, for example, a Doppler system that includes (i) a light emitting element which irradiates laser light to a measuring target and (ii) a light receiving element which receives reflected light of the laser light from the measuring target, so as to measure a speed from a change in frequency of the reflected light. Detection of the circumferential speed of the pickup roller 6 may be carried out by providing a rotary encoder on a same shaft as the pickup roller 6. More specifically, well-known sensors may be used as appropriate for the sensors 121 and 122.

Here, the document carrying control section 110 uses an acceleration table as illustrated in FIG. 9, in order to control the pickup roller 6. The acceleration table provides a relationship between measured slip ratios λx and corresponding accelerations a of the pickup roller 6.

The acceleration α is a start-up acceleration of the pickup roller 6 at the time when paper is started to be fed from the document mounting tray 5. In the present embodiment, a slip ratio per one document calculated while a document is carried from the document mounting tray 5 by the pickup roller 6 is denoted as a slip ratio λ, and a slip ratio calculated based on a plurality of slip ratios λ is denoted as a measured slip ratio λx. Additionally, the acceleration table indicates acceleration α of the pickup roller 6 for each of the measured slip ratios λx.

In the present embodiment, the acceleration table is set so that when a total number of carried documents C is not more than 1000 sheets, the acceleration α is set to the maximum acceleration α10. When the total number of carried documents C is more than 1000 sheets, the acceleration α is set to one of accelerations α10 to α2 in accordance with the measured slip ratio λx. Note that the acceleration α gradually decreases as the number decreases from α10 to α2, and the measured slip ratio λx gradually increases as the number increases from λ1 to λ9.

In the acceleration table, slipping of the pickup roller 6 does not readily occur while the total number of carried documents C is not more than 1000 sheets. Thus, carrying performance of the pickup roller 6 is maintained in this period. In this period, occurrence of slipping is considered as an accidental case, and therefore the acceleration α is set to the maximum acceleration. On the other hand, it is considered that the pickup roller 6 is abraded when the total number of carried documents C is more than 1000 sheets. Therefore, the acceleration α is gradually decreased in accordance with an increase in the measured slip ratio λx.

The slip ratio λ is calculated by the document carrying control section 110 based on (i) a carrying speed of a document (document speed) from the document mounting tray 5 that is measured by the document speed sensor 121 and (ii) the circumferential speed of the pickup roller 6 which is detected by the roller circumferential speed sensor 122. More specifically, λ is calculated by the following formula:

$$\lambda = \frac{V_R - V_P}{V_R}$$

$V_R$ : Pickup roller speed $V_P$ : Paper (document) speed

Figure 10:
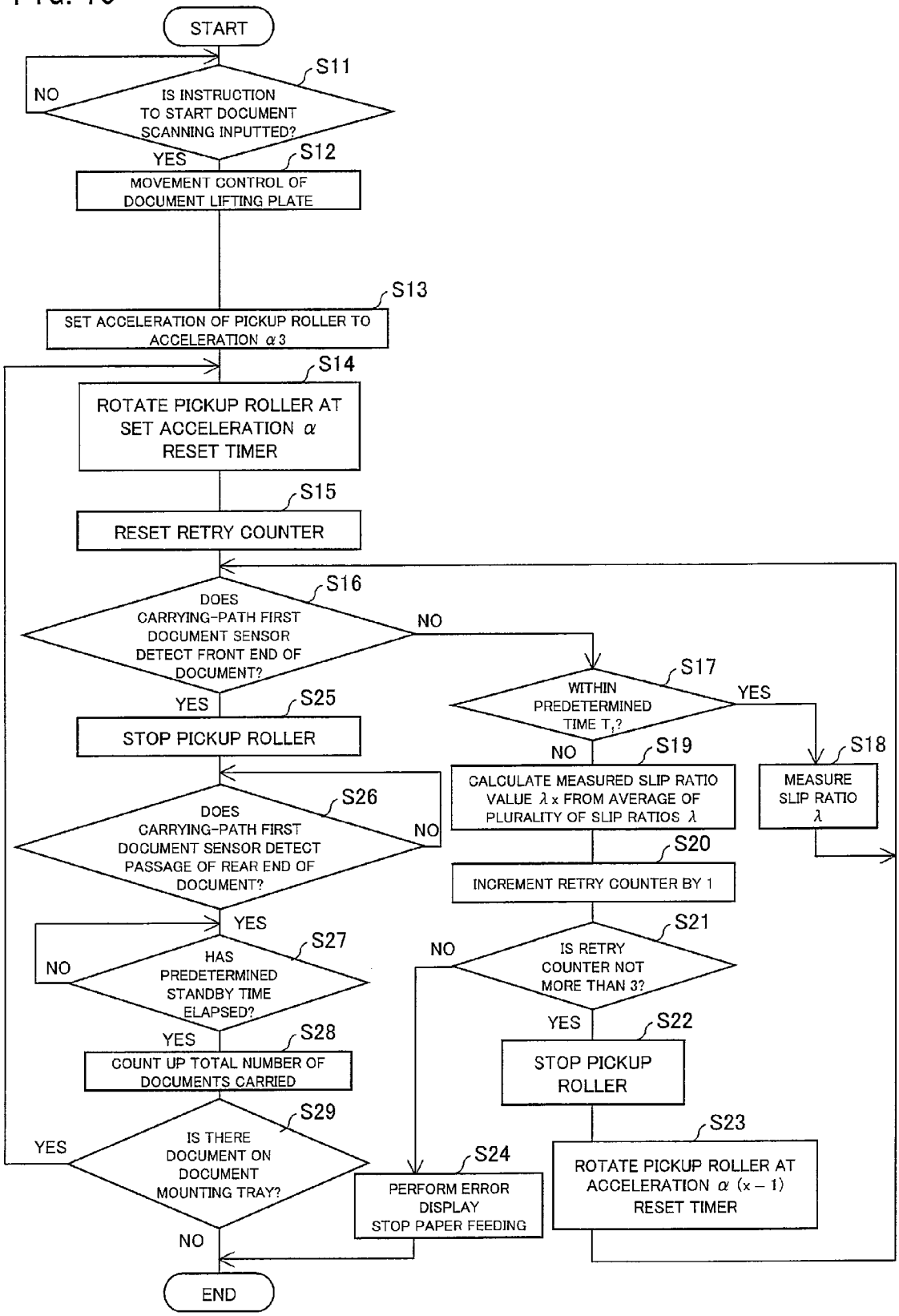
FIG. 10 is a flow chart illustrating a document carrying operation in a document scanning apparatus which document carrying operation is controlled by the document carrying control section illustrated in FIG. 8.

FIG. 10 is a flow chart illustrating a document carrying operation under the control of the document carrying control section 110 in the document scanning apparatus 100.

In FIG. 10, the document carrying control section 110 of the document scanning apparatus 100 is on standby, until an instruction to start document scanning is inputted, for example, at the operation panel 106 (S11). When an instruction to start document scanning is inputted at the operation panel 106, this instruction is inputted into the document carrying control section 110 via the main control section 101.

Receiving the instruction to start document scanning, the document carrying control section 110 carries out movement control to raise the document lifting plate 5*a* (S12). In this control, the document control section 110 rotates the cam driving motor 114 until the upper surface detecting sensor 115 detects the upper surface of a document. When the upper surface detecting sensor 115 detects an upper surface of a document, the document control section 110 stops rotation of the cam driving motor 114. This movement control of the document lifting plate 5*a* is carried out concurrently with document carrying control.

Then, the document carrying control section 110 sets an acceleration α that succeeded in previous paper feeding as the acceleration of the pickup roller 6 at the start of paper feeding. Alternatively, in a case where the document scanning apparatus 100 is to be used for the first time since (i) manufacture thereof or (ii) after replacement of the pickup roller 6, the maximum acceleration (acceleration α10) is set as the acceleration of the pickup roller 6 at the start of paper feeding.

The document carrying control section 110, once the acceleration α of the pickup roller 6 is set, transmits, to the speed controller 218, a command which instructs the speed controller 218 to start-up the pickup roller 6 at the acceleration α thus set. Concurrently, the document carrying control section 110 resets a timer (slip detecting device) (S13).

The speed controller 218 having received the control command controls the roller first driving motor 116 so that the pickup roller 6 rotates at the set acceleration α. In this case, the carrying roller 7*a* also rotates at the set acceleration α. This state is illustrated in FIG. 6. Note that the slip ratio λ is set to λ1, its minimum value, at a time (i) immediately after manufacture of the document scanning apparatus 100 and (ii) immediately after replacement of the pickup roller 6. Therefore, in this case, the acceleration is set to α10 which is its maximum value.

Subsequently, the document carrying control section 110 resets a retry counter (S15). This retry counter counts the number of times of retries of a paper feeding operation for each document.

Next, in a case where a front end of a document is detected by the carrying-path first document sensor 118 (sensor output OFF→ON) (S16), paper feeding is successful. Then, the document carrying control section 110 transmits, to the speed controller 218, a control command to stop the pickup roller 6 so as to prepare for paper feeding of a next page (S25). Accordingly, the speed controller 218 stops the roller first driving motor 116, that is, the pickup roller 6 and the carrying roller 7*a*, according to the control command.

On the other hand, in a case where a front end of a document is not detected by the carrying-path first document sensor 118 in S16, and a predetermined time T1 has not elapsed in measurement by the timer (S17), the slip ratio λ is calculated from detection results of the document speed sensor 121 and the roller circumferential speed sensor 122, as the aforementioned (S18). The document carrying control section 110 calculates the slip ratio λ while each document is carried, and stores the slip ratio λ thus calculated.

If the predetermined time T1 has elapsed in measurement by the timer before the carrying-path first document sensor 118 detects the front end of the document, the document carrying control section 110 determines that the document carrying is delayed due to a slip of the pickup roller 6. In such a case, an average value of a plurality of the slip ratios λ thus calculated in S18 is calculated. This average value is stored as the measured slip ratio λx (S19). Subsequently, the retry counter is incremented by 1 (S20). When a value of the retry counter is equal to or less than 3 (S21), the paper feeding operation is retried.

In this retry, the document carrying control section 110 transmits, to the speed controller 218, a command to once stop the pickup roller 6 (S22) and a command to subsequently carry out accelerated rotation of the pickup roller 6 at an acceleration α(x−1) (S23). The acceleration α(x−1) is an acceleration decreased by one stage from the acceleration αx. Simultaneously, the document carrying control section 110 resets the timer (S23), and returns to S16. Note that the acceleration αx corresponds to the measured slip ratio λx, in the acceleration table shown in FIG. 9. The speed controller 218 controls the roller first driving motor 116 according to the command from the document carrying control section 110 so as to once stop the pickup roller 6 and subsequently carry out accelerated rotation of the pickup roller 6 at the acceleration α(x−1).

On the other hand, when the value of the retry counter is more than 3 in S21, for example, an error display is performed by the operation panel 106, and the document feeding operation from the document mounting tray 5 is stopped (S24).

Further, after the pickup roller 6 stops in S25, it is determined whether or not a rear end of the document has passed the carrying-path first document sensor 118 (sensor output ON→OFF) (S26). If a result of the determination is YES, the document carrying control section 110 stands by until a predetermined standby time elapses (S27).

Then, when the predetermined standby time has elapsed, the document carrying control section 110 counts up a total number of carried documents C (S28). This total number of carried documents C is initially set as 1 immediately after manufacture of the document scanning apparatus 100 or immediately after replacement of the pickup roller 6. The total number of carried documents C is updated every time a document carrying operation is performed.

Thereafter, presence of a document on the document mounting tray 5 is determined from respective detection signals of the document-tray first document sensor 111 and the document-tray second document sensor 112 (S29). If a document is still present on the document mounting tray 5, the document carrying control section 110 returns to S14 and repeats processes subsequent to S14. On the other hand, if a document is not present on the document mounting tray 5, the document carrying control section 110 ends the process.

In the processes of S21 through S23, the document carrying control section 110 controls the acceleration to be decreased by one stage from a current acceleration αx, when the value of the retry counter is equal to or less than 3. Alternatively, the document carrying control section 110 may have an arrangement in which, for example, a stepwise acceleration is set according to the value of the retry counter. For example, in such an arrangement, when the value of the retry counter is 1, a start-up acceleration of the pickup roller 6 may be set to an acceleration α (x−1), that is, an acceleration decreased by one stage from the current acceleration αx, and, when the value of the retry counter is 2 or 3, the start-up acceleration of the pickup roller 6 may be set to acceleration α (x−2), that is, an acceleration decreased by two stages from the current acceleration αx. Such setting makes it possible to reliably carry a document from the document mounting tray 5 in a second retry at the acceleration α(x−2) decreased in acceleration by two stages, even in a case where the pickup roller 6 slips in the first retry at the acceleration α(x−1) decreased in acceleration by one stage.

The above example refers to the acceleration table shown in FIG. 9 based on the measured slip ratio λx that is the average value of the slip ratios λ calculated in S18. Alternatively, the acceleration α of the pickup roller 6 may be set as follows: (1) the slip ratio λ is calculated every time one document is carried by the pickup roller 6, (2) an average value of the slip ratios λ is calculated every time a predetermined number of documents are carried, and (3) the acceleration α of the pickup roller 6 is set based on the average value of the slip ratios λ thus obtained, with reference to the acceleration table shown in FIG. 9. The average value of the slip ratios λ in this case is calculated by, for example, (i) calculating a slip ratio λc each time a document is carried, and (ii) after ten documents have been carried, an average value of the ten slip ratios λ is calculated by: (λc+λc−1+λc−2+ . . . +λc−10)÷10. Such arrangement allows prevention of a situation where an acceleration to be set is changed due to a sudden change in slip ratio, which sudden change is caused by the document.

Moreover, the acceleration α of the pickup roller 6 may be set as follows: (1) a slip ratio λ is calculated each time one document is carried by the pickup roller 6, (2) a mode of the slip ratios λ (the slip ratio λ which appears the most frequently) is found for each predetermined number of carried documents, and (3) the acceleration α of the pickup roller 6 is set based on the mode of the slip ratios λ, with reference to the acceleration table shown in FIG. 9. Such arrangement, as similar to the aforementioned, allows prevention of a situation where an acceleration to be set is changed due to a sudden change in slip ratio, which sudden change is caused by the document.

As explained above, in the document scanning apparatus 100, when delay occurs in document carrying of a document from the document mounting tray 5 by the pickup roller 6, it is determined that the slip of the pickup roller 6 has occurred. Then, the pickup roller 6 is once stopped and a start-up acceleration of the rotation of the pickup roller 6 is decreased. This prevents the pickup roller 6 from slipping, and also makes it possible to carry a document on the document mounting tray 5 by the pickup roller 6 more reliably.

Figure 11:
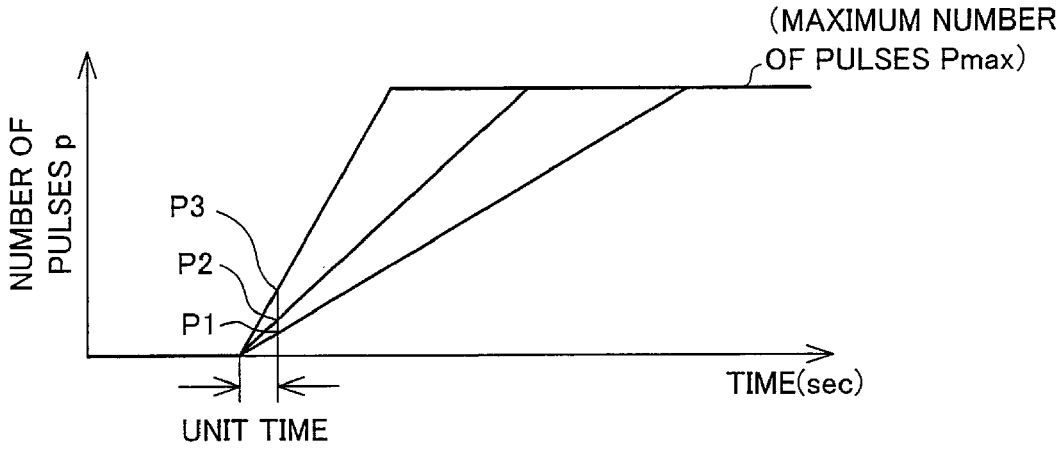
FIG. 11(*a*) is an explanatory diagram illustrating a control operation with respect to the pickup roller, which control operation is performed by a speed controller shown in FIG. 8.

FIG. 11(*a*) is an explanatory diagram illustrating a control operation with respect to the roller first driving motor 116, that is, the pickup roller 6 which control operation is performed by the speed controller 218. For convenience, in the following explanation, three examples are discussed as the acceleration α: a high acceleration α3, an intermediate acceleration α2, and a low acceleration α1.

The speed controller 218 controls the speed of the roller first driving motor 116, that is, the speed of the pickup roller 6, according to the command from the document carrying control section 110. The roller first driving motor 116 is a stepping motor. The speed of the roller first driving motor 116 is controlled by the number of pulses per unit time which pulses are outputted from the speed controller 218. As illustrated in FIG. 11(*a*), an increase in the number of pulses per unit time is P3 in the case of the high acceleration α3. The increase in the number of pulses per unit time is P2 in the case of the intermediate acceleration α2. Further, the increase in the number of pulses per unit time is P1 in the case of the low acceleration α1.

FIG. 11(*b*) is a graph illustrating a relationship between a time period and the number of pulses (the number of pulses in proportion to a roller speed) that are outputted from the speed controller 218. As illustrated in FIG. 11(*b*), a maximum speed of the pickup roller 6 is Pmax in any acceleration. When the maximum speed is converted into a peripheral velocity of the pickup roller 6, the maximum speed is approximately 600 mm/s.

When the longest time period taken to reach an ultimate speed is 90 msec and the shortest time period taken to reach the ultimate speed is 30 msec in a case where the speed of 600 mm/s is the maximum speed of the pickup roller 6, that is, the ultimate speed that the pickup roller 6 reaches after start-up, the low acceleration α1, the intermediate acceleration α2, and the high acceleration α3 are as follows, respectively.

Low Acceleration α1: 600÷0.09=6667(mm/sec$^2$)

Intermediate Acceleration α2: 600÷0.06=10000(mm/sec$^2$)

High Acceleration α3: 600÷0.03=20000(mm/sec$^2$)

Second Embodiment

The following description describes another embodiment of the present invention with reference to drawings. In the present embodiment, the document carrying control section 110 is arranged so as to calculate a measured slip ratio λx with respect to each document size. For convenience, the description deals with two types of document sizes; a large size and a small size.

When the document size is large, a slip of the pickup roller 6 is likely to occur because a frictional force is large due to a large contact area between the document and another document (sheet). Accordingly, a measured slip ratio λx is calculated according to the size of the document (size of the sheet) to be carried. This allows control of the acceleration of the pickup roller 6 according to the document size. For example, even if a slip ratio increases for a large size document, only the acceleration for carrying the large size document is required to be decreased if the slip ratio does not increase for a small size document.

Figure 12:
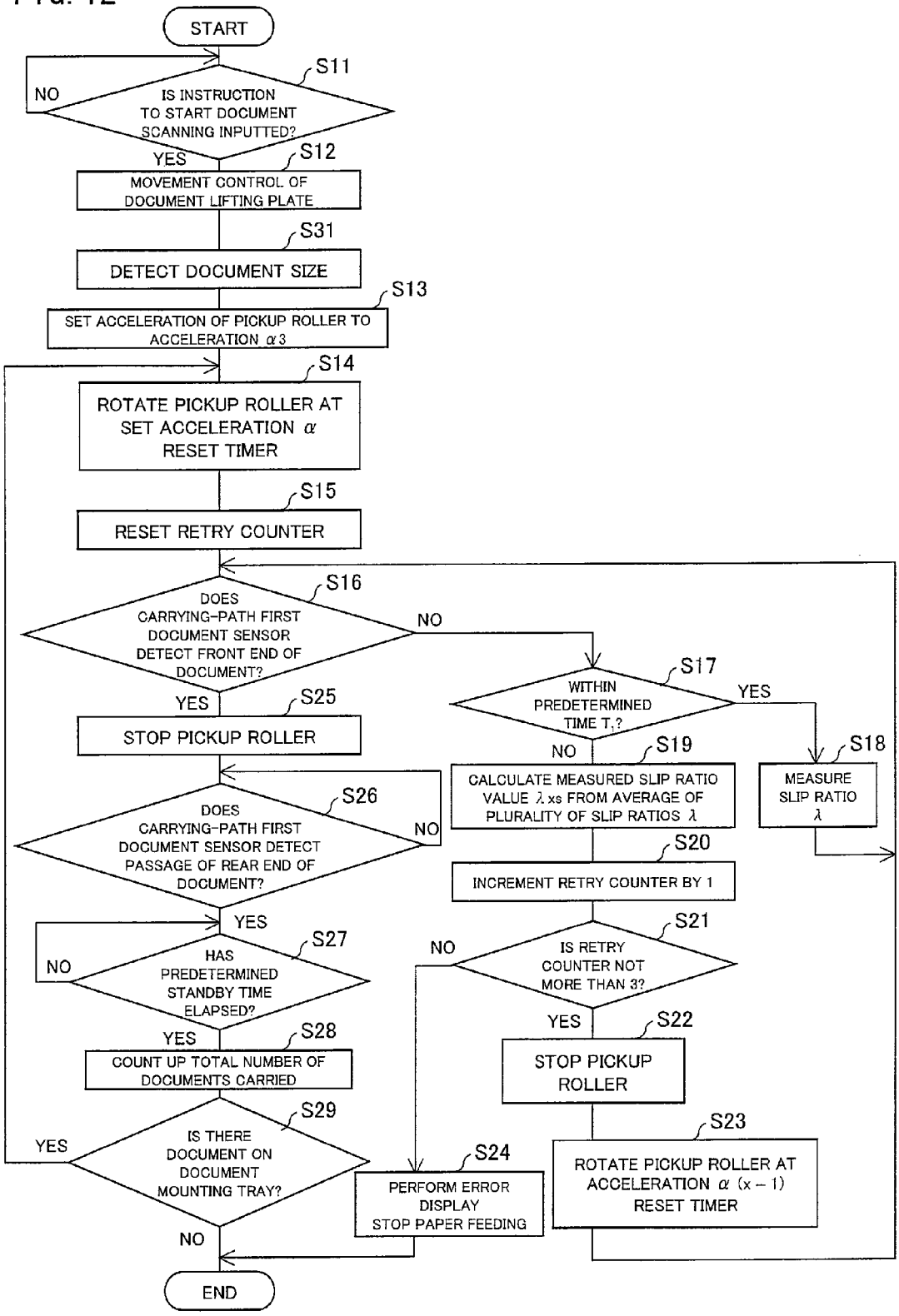
FIG. 12 illustrates another embodiment of the present invention, and is a flow chart illustrating a document carrying operation in a document scanning apparatus, which document carrying operation is controlled by the document carrying control section illustrated in FIG. 8.

FIG. 12 is a flow chart illustrating a document carrying operation in a document scanning apparatus 100, which document carrying operation is controlled by the document carrying control section 110 of the present embodiment. In FIG. 12, an operation of detecting a document size (S31) is added to the flow illustrated in FIG. 10.

In FIG. 12, the document carrying control section 110 of the document scanning apparatus 100 is on standby, until an instruction to start document scanning is inputted, for example, at the operation panel 106 (S11). When an instruction to start document scanning is inputted at the operation panel 106, this instruction is inputted into the document carrying control section 110 via the main control section 101.

Receiving the instruction to start document scanning, the document carrying control section 110 carries out movement control to raise the document lifting plate 5*a* (S12).

Then, the document carrying control section 110 determines a size of the document to be carried (S31). This determination is made based on a detection signal from the document-tray first document sensor 111 and the document-tray second document sensor 112.

Then, the document carrying control section 110 sets an acceleration α for the size of the document thus detected in S31, which acceleration succeeded in previous paper feeding as the acceleration of the pickup roller 6 at the start of paper feeding. Alternatively, in a case where the document scanning apparatus 100 is to be used for the first time since (i) manufacture thereof or (ii) after replacement of the pickup roller 6, the maximum acceleration (acceleration α10) is set as the acceleration of the pickup roller 6 at the start of paper feeding.

The document carrying control section 110, once the acceleration α of the pickup roller 6 is set, transmits, to the speed controller 218, a command which instructs the speed controller 218 to start-up the pickup roller 6 at the acceleration α thus set. Concurrently, the document carrying control section 110 resets a timer (S13). The subsequent operations carried out in S14 through S17 are the same as the flow chart illustrated in FIG. 10.

In a case where a front end of a document is not detected by the carrying-path first document sensor 118 in S16, and a predetermined time T1 has not elapsed in measurement by the timer (S17), the slip ratio λ is calculated from detection results of the document speed sensor 121 and the roller circumferential speed sensor 122, as the aforementioned (S18). Accordingly, the slip ratio λ that is calculated before the predetermined time period T1 elapses in measurement by the timer is stored as the slip ratio λ for the document size.

Subsequently, if the predetermined time T1 has elapsed in measurement by the timer before the carrying-path first document sensor 118 detects the front end of the document, the document carrying control section 110 determines that the document carrying is delayed due to a slip of the pickup roller 6. In such a case, an average value of a plurality of slip ratios λ thus calculated in S18 is calculated. This average value is stored as a measured slip ratio λxs for the document size (S19). The subsequent operations in S20 through S29 are the same as the flow chart illustrated in FIG. 10.

In the operation of S19, for example, when the document is of a large size, the measured slip ratio λxs is stored as λx2 with s=2, and when the document is of a small size, the measured slip ratio λxs is stored as λx1 with s=1. This process allows appropriate setting of the acceleration α of the pickup roller 6 in accordance with the document size.

Modifications to the arrangement explained in First Embodiment may be similarly applied to the arrangement of the present embodiment. Functions attained by the modifications are also the same as First Embodiment.

Third Embodiment

The following explains further another embodiment of the present invention, with reference to drawings.

Figure 13:
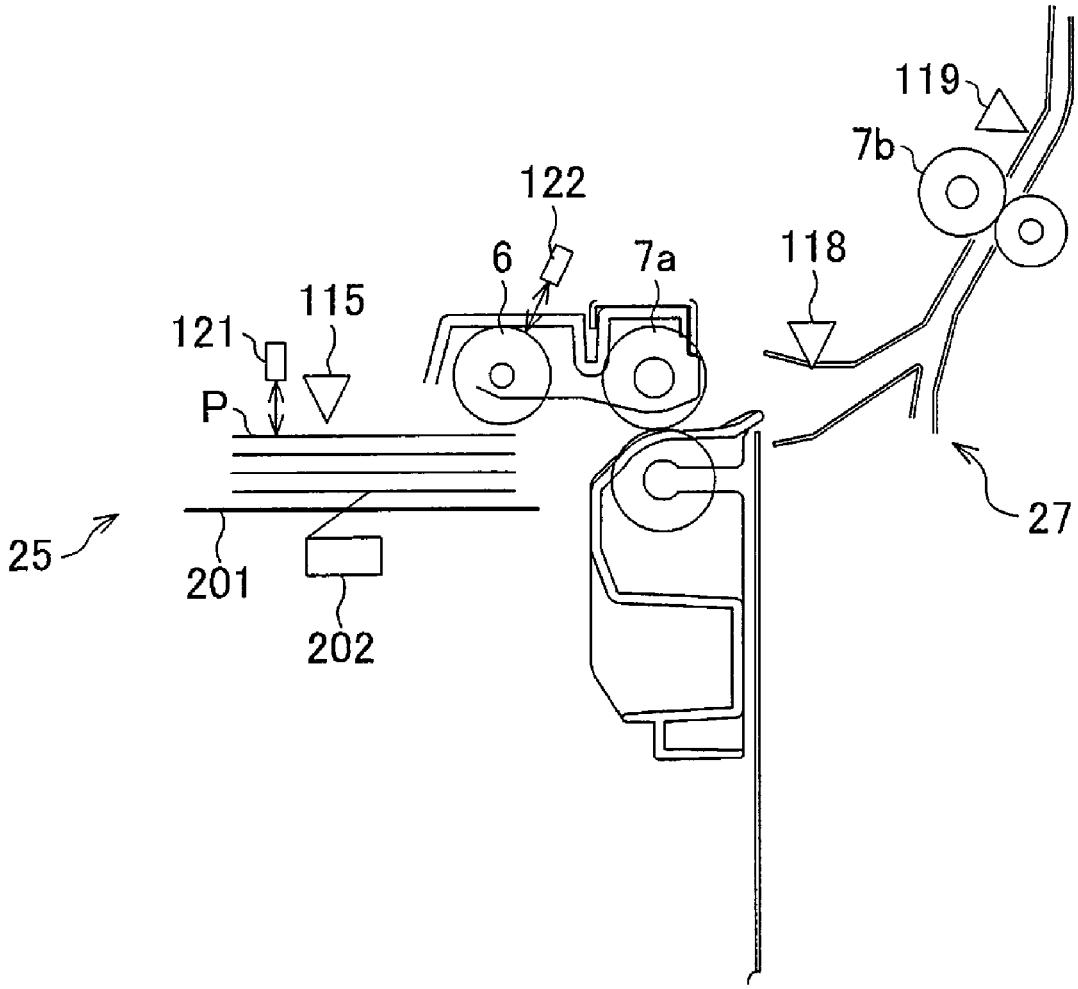
FIG. 13 illustrates further another embodiment of the present invention, and is a longitudinal sectional view schematically illustrating an arrangement in the vicinity of a paper feeding section of an image forming apparatus in a case where a sheet carrying device of the present invention is applied to the image forming apparatus illustrated in FIG. 1.

In embodiments explained above, an arrangement of the present invention is explained by raising a document scanning apparatus 100 as an example. However, the present invention is not limited to this. For example, as illustrated in FIG. 13, the present invention is applicable to an arrangement in which a sheet is fed from a paper feeding section in an image forming apparatus 11. That is, arrangements of the above-explained embodiments 1 and 2 are applicable to the image forming apparatus 11 illustrated in FIG. 13.

As illustrated in FIG. 13, in the image forming apparatus 11, a paper feeding tray 25 as a paper feeding section corresponds to a document mounting tray 5. The paper feeding tray 25 includes a paper lifting plate 201 corresponding to a document lifting plate 5*a*, a paper sensor 202 corresponding to a document-tray first document sensor 111 and a document-tray second document sensor 112, and an upper surface detecting sensor 115. Furthermore, the image forming apparatus 11 includes a document speed sensor 121 and a roller circumferential speed sensor 122. Paper P on the paper feeding tray 25 is picked up by a pickup roller 6 one by one from the paper feeding tray 25 and carried through a paper carrying path 27 by carrying rollers 7*a* and 7*b*. A paper carrying state in the paper carrying path 27 is detected by a carrying-path first document sensor 118 and a carrying-path second document sensor 119.

Regarding the above-explained embodiments, the following provides an explanation of a reason why a slip of the pickup roller 6 can be prevented by reducing a start-up acceleration of the pickup roller 6.

Figure 14:
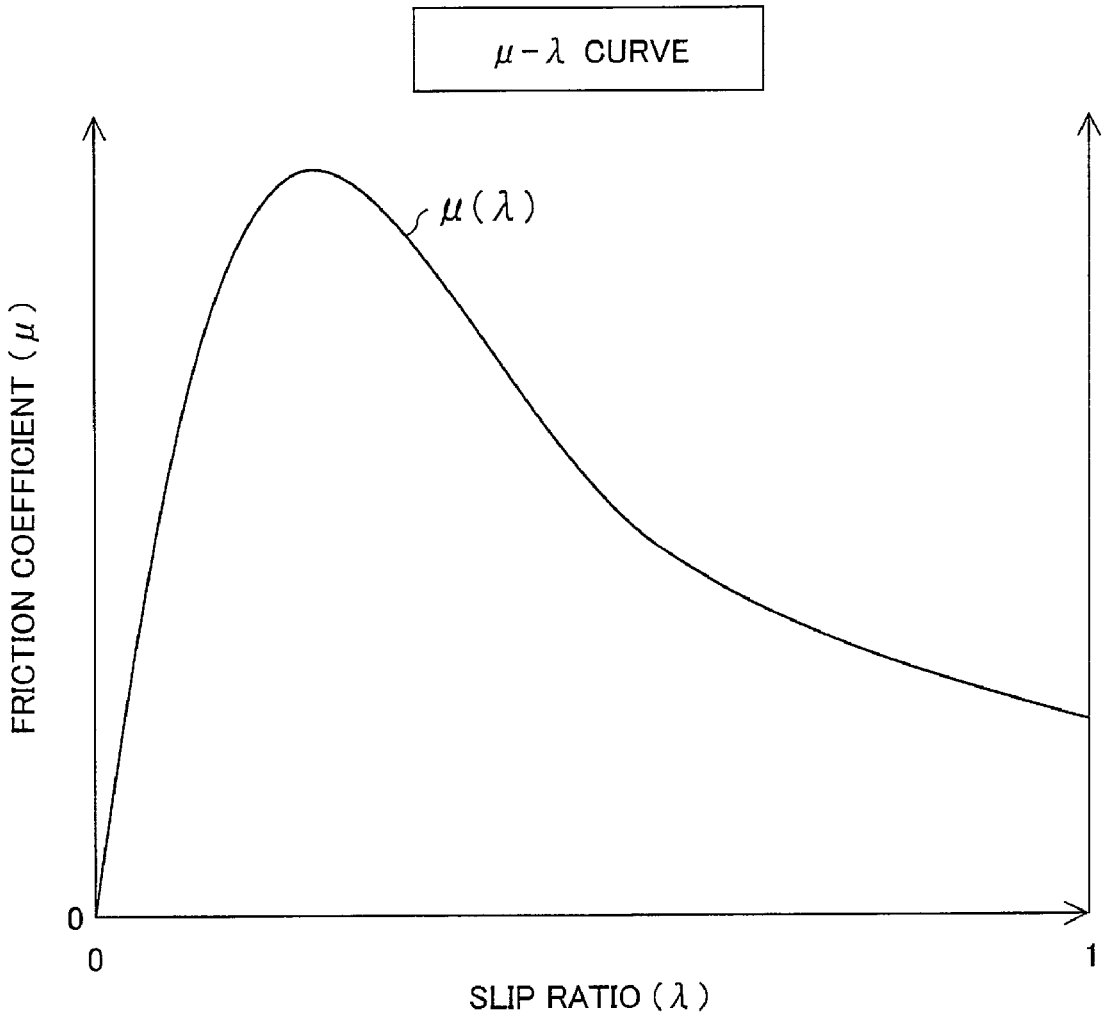
FIG. 14 explains a principle of a slip suppression of a pickup roller in a sheet carrying device in an embodiment of the present invention, and is a graph illustrating a relationship ($\mu$-$\lambda$ curve) between (i) a slip ratio $\lambda$ of the pickup roller and (ii) a friction coefficient $\mu$ between the pickup roller and a document.

FIG. 14 is a graph illustrating a relationship (μ-λ curve) between a slip ratio λ and a friction coefficient μ between the pickup roller 6 and a document (paper, sheet).

Figure 15:
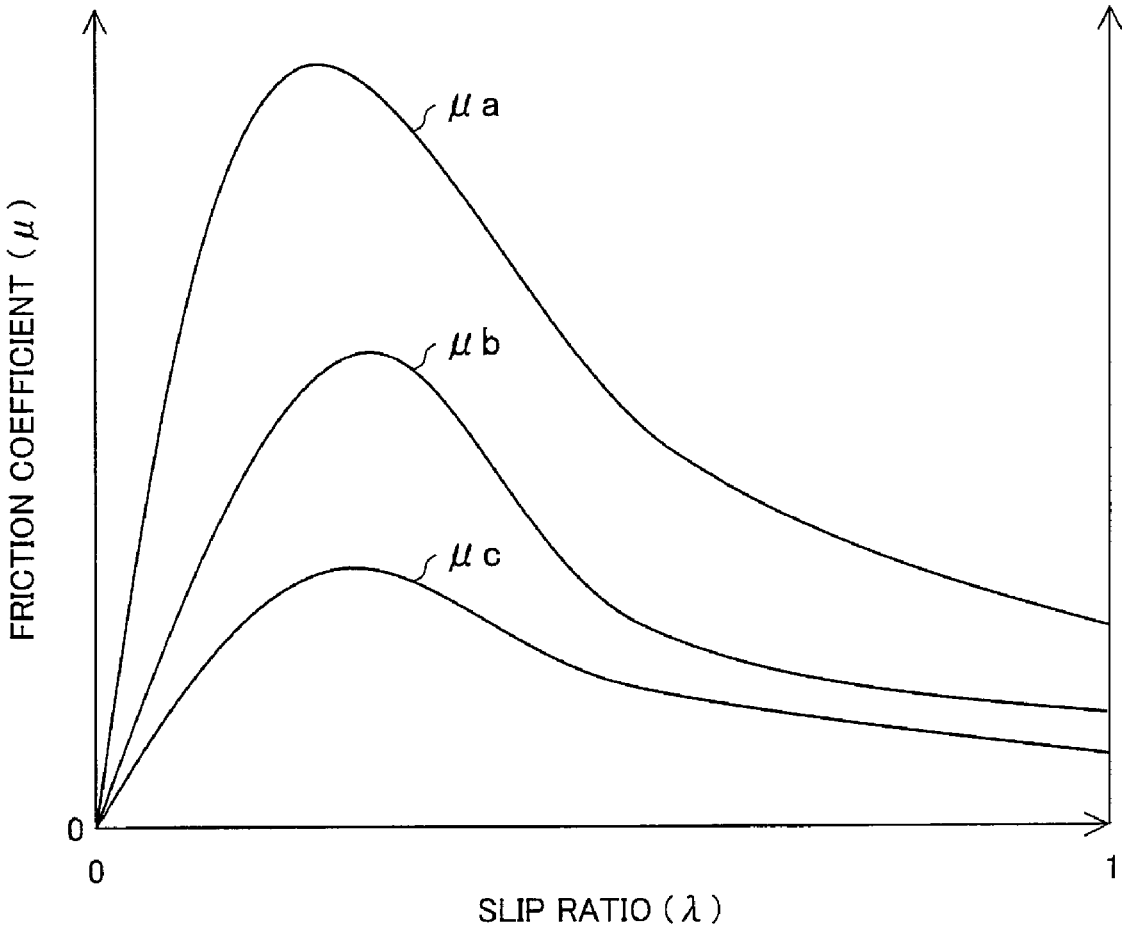
FIG. 15 is a graph illustrating $\mu$-$\lambda$ curves, as illustrated in FIG. 14, of a plurality of examples of the friction coefficient $\mu$ between the pickup roller and a document (paper, sheet).

FIG. 15 illustrates a plurality of μ-λ curves. In a case where the pickup roller is abraded or a surface of a document (paper, sheet) slips, the μ-λ curve lowers in the order of μa→μb→μc.

Figure 16:
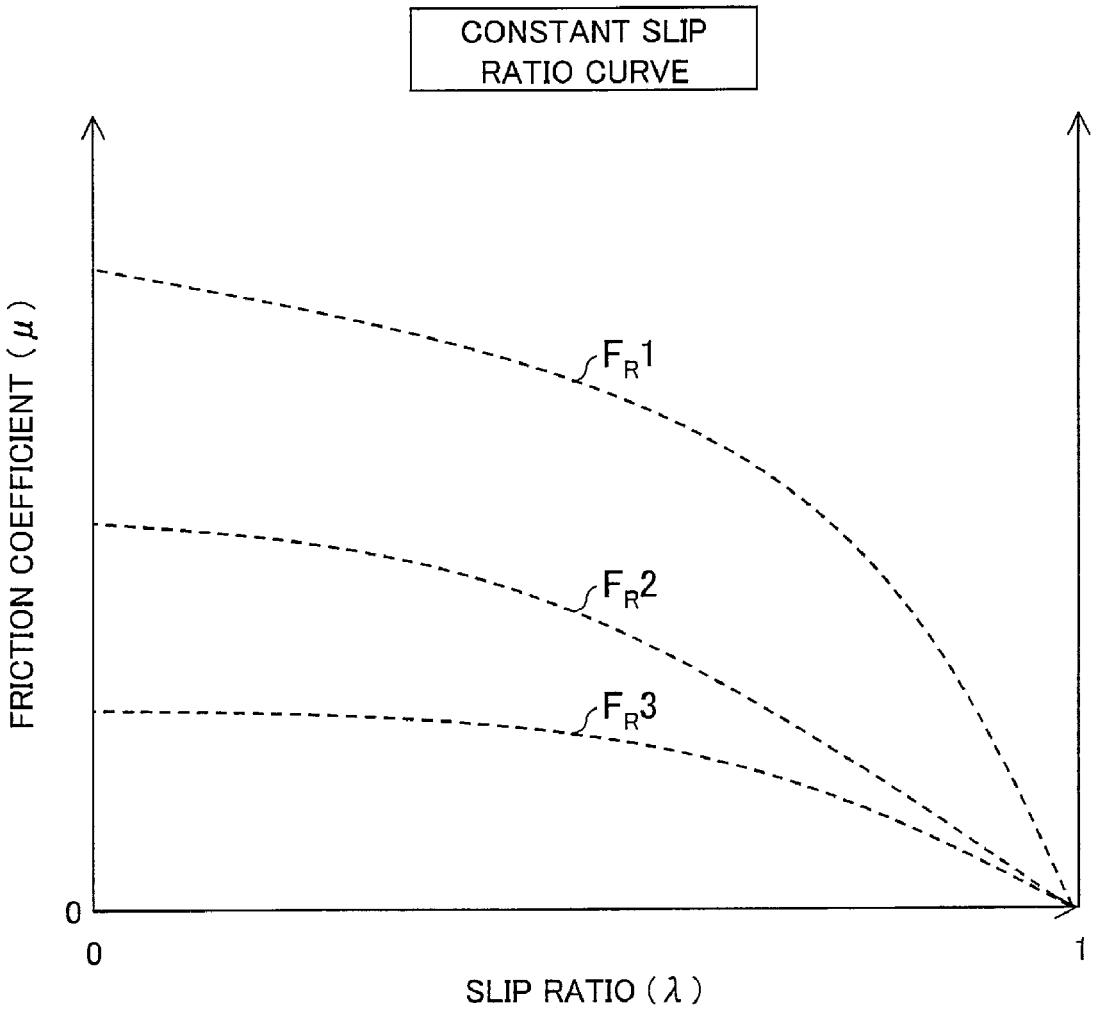
FIG. 16 is a graph illustrating constant slip ratio curves showing relationships of a driving torque (FR) of a pickup roller, a slip ratio ($\lambda$), and a friction coefficient ($\mu$).

FIG. 16 is constant slip ratio curves illustrating a relationship of a drive torque (FR) of a pickup roller, a slip ratio (λ), and a friction coefficient (μ). The drive torque decreases in the order of FR1→FR2→FR3. An equation of the constant slip ratio curve is determined by an equation (9) described in a constant slip ratio curve of a paper carrying system later explained. Note that the equation (9) is identical with an equation (7) described in Non-Patent Document 1.

Figure 17:
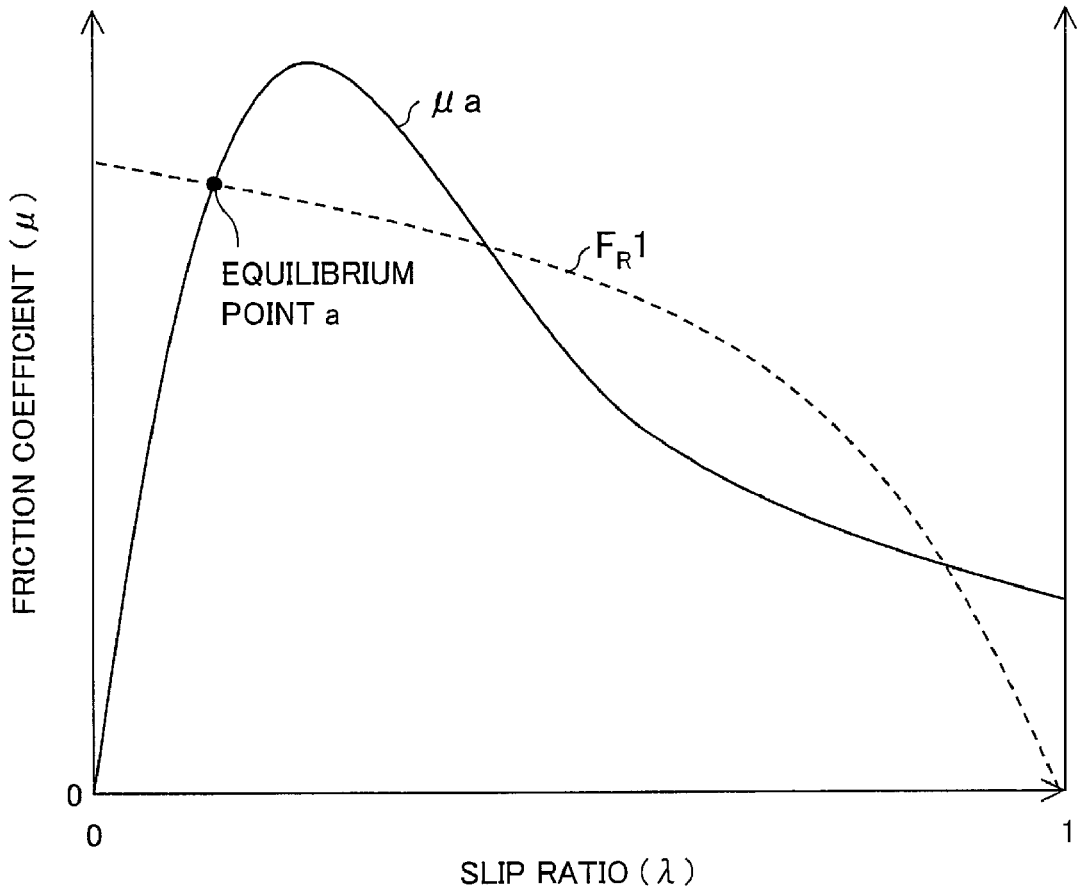
FIG. 17 is a graph illustrating a relationship between a $\mu$-$\lambda$ curve and a constant slip ratio curve, at the time when a frictional force between a pickup roller and a sheet is large.

FIG. 17 is a graph illustrating a relationship between a μ-λ curve of FIG. 15 and a constant slip ratio curve of FIG. 16, at the time when a frictional force between the pickup roller and the sheet is large. When the frictional force between the pickup roller and the sheet is large, the pickup roller does not slip on the sheet even in a case where the pickup roller is rotating at a large torque FR1 (high acceleration). Accordingly, the sheet is fed at an equilibrium point a and a slip ratio λ is low.

Figure 18:
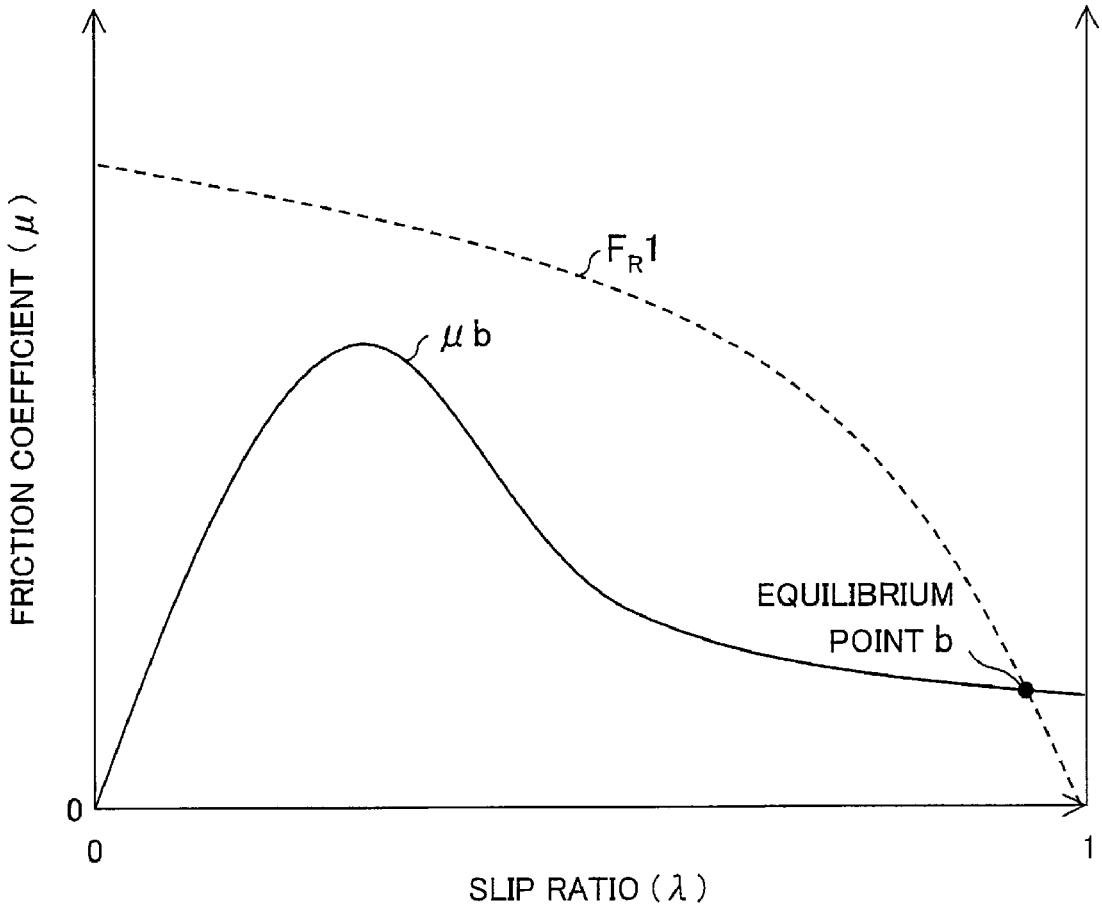
FIG. 18 is a graph illustrating a relationship between a $\mu$-$\lambda$ curve and a constant slip ratio curve, at the time when a frictional force between a pickup roller and a sheet is decreased.

FIG. 18 is a graph illustrating a relationship between a μ-λ curve and a constant slip ratio curve, at the time when a frictional force between a pickup roller and a sheet is decreased. When the frictional force between the pickup roller and the sheet is small, the pickup roller slips on the sheet in a case where the pickup roller rotates at a large torque FR1 (high acceleration). Accordingly, the sheet is fed at an equilibrium point b and the slip ratio λ is high.

Figure 19:
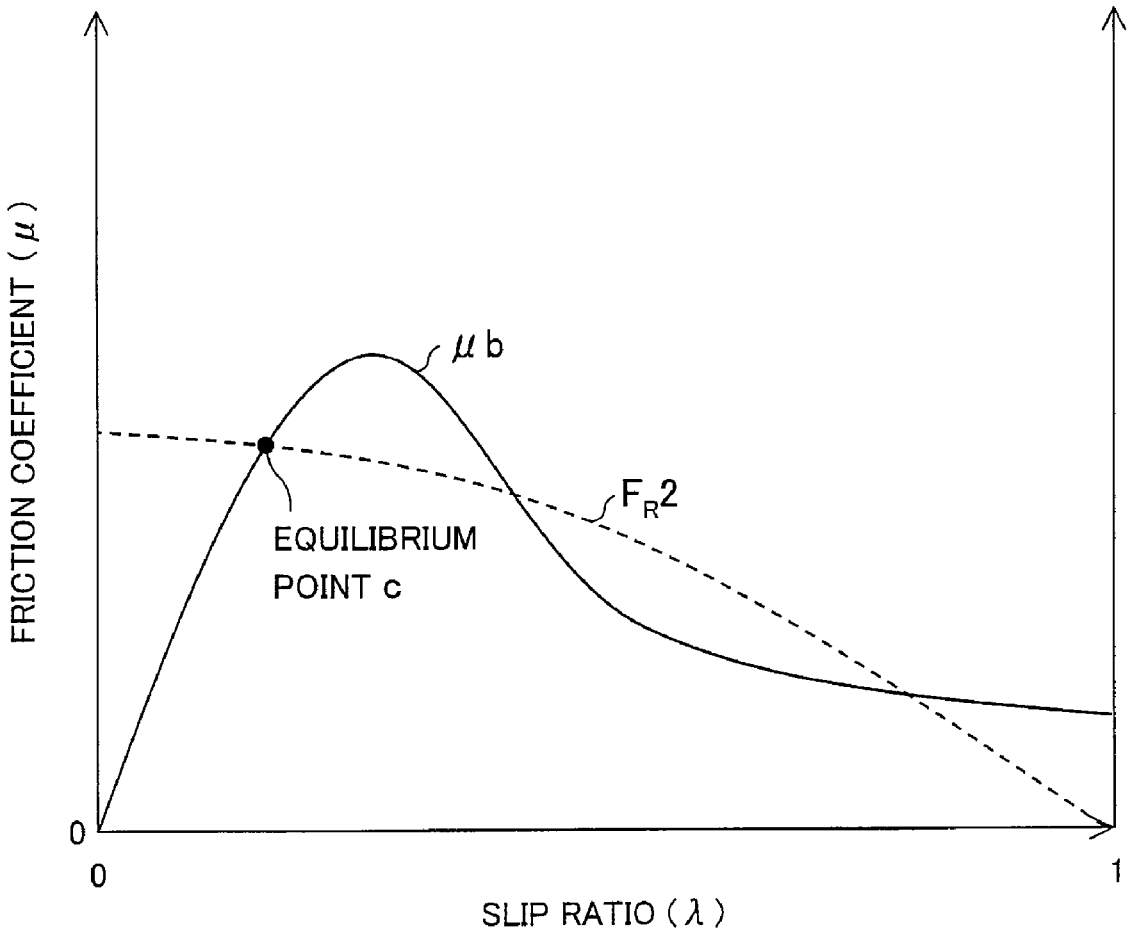
FIG. 19 is a graph illustrating a relationship between a $\mu$-$\lambda$ curve and a constant slip ratio curve, in a case where a torque (acceleration) of a pickup roller is decreased at the time when a frictional force between the pickup roller and the sheet is decreased.

FIG. 19 is a graph illustrating a relationship between a μ-λ curve and a constant slip ratio curve, in a case where a torque (acceleration) of the pickup roller is decreased at the time when a frictional force between the pickup roller and the sheet is decreased. When the friction coefficient between the pickup roller and the sheet is small, the pickup roller does not slip on the sheet in a case where the pickup roller rotates at an intermediate torque FR2 (intermediate acceleration). Accordingly, the sheet is fed at an equilibrium point c and the slip ratio λ is low.

As explained above, when the slip of the pickup roller occurs (a state of FIG. 18), the occurrence of another slip can be prevented by decreasing the acceleration of the pickup roller (a state of FIG. 19).

Figure 20:
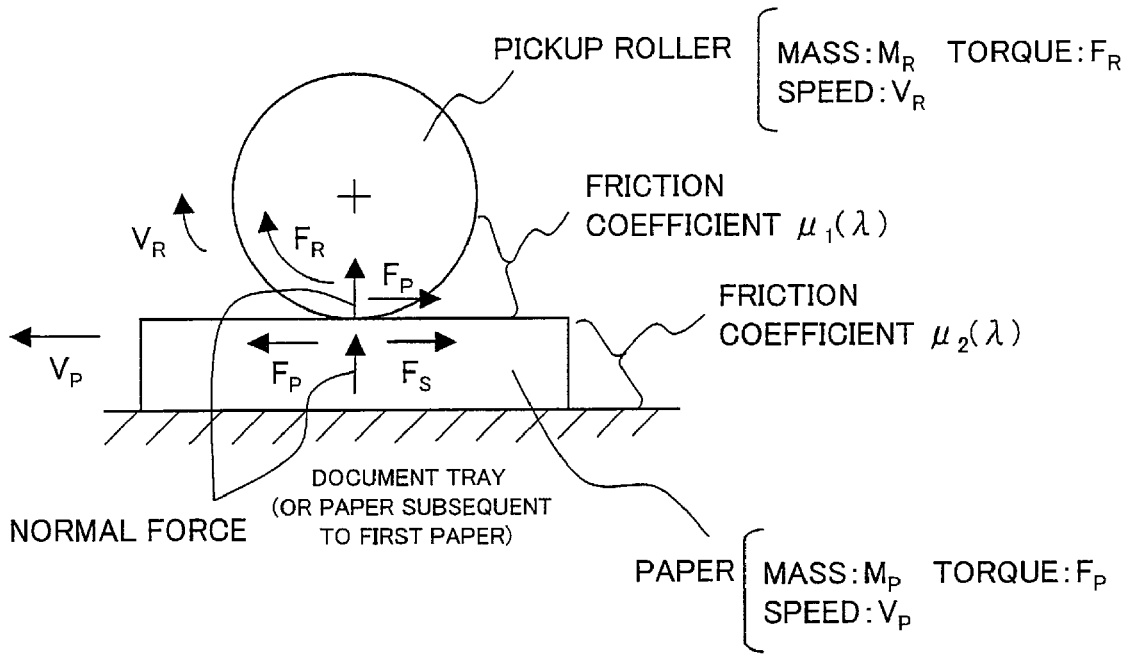
FIG. 20 is used to explain a constant slip ratio curve of a paper carrying system, and is a diagram schematically illustrating a state in which paper on a document mounting tray is carried by a pickup roller.

The physical phenomenon of the slip is explained in detail in Non-Patent Document 1 (Basic Study on Traction Control of Electric Vehicle). Non-Patent Document 1 raises an electric vehicle as an example. However, the same phenomenon as in Non-Patent Document 1 occurs in carrying a sheet (paper). This is proven in the constant slip ratio curve of a paper carrying system below, with reference to FIG. 20. In other words, the following proves that the same relationship as in the equation (7) described in Non-Patent Document 1 is established in coefficients in a sheet (paper) carrying operation. Note that FIG. 20 is a diagram schematically illustrating a state in which a sheet on a document mounting tray is carried by a pickup roller.

A kinematic equation of paper and the pickup roller is obtained as follows:

$$M_R \frac{dV_R}{dt} = F_R - F_p; \tag{1}$$

$$M_P \frac{dV_P}{dt} = F_P - F_s; \tag{2}$$

-continued $$F_P = M_R \cdot g \cdot \mu_1(\lambda); \tag{3}$$

$$F_s = (M_R + M_P) \cdot g \cdot \mu_2(\lambda), \tag{4}$$

(g: gravitational acceleration);

because $M_R >> M_P$ in the equation (4), $$F_S = M_R \cdot g \cdot \mu_2(\lambda) \tag{5}$$

substituting the equations (3) and (5) into the equation (2), $$\begin{aligned} M_P \frac{dV_P}{dt} &= M_R \cdot g \cdot \mu_1(\lambda) - M_R \cdot g \cdot \mu_2(\lambda) \\ &= M_R \cdot g \cdot (\mu_1(\lambda) - \mu_2(\lambda)); \end{aligned}$$

because $\mu_1(\lambda) >> \mu_2(\lambda)$ (i.e., because a frictional force between rollers and paper is greater than a frictional force between the paper and the document tray (or subsequent paper)), $$\begin{aligned} M_P \frac{dV_P}{dt} &= M_R \cdot g \cdot \mu_1(\lambda)\text{; and} \\ &= F_P \end{aligned} \tag{6}$$

from the equations (1) and (6), $$\frac{F_R - F_P}{F_P} = \frac{M_R}{M_P} \cdot \frac{dV_R}{dV_P}. \tag{7}$$

Here, because the slip ratio is in an equilibrium state, $$\lambda_0 = \frac{V_R - V_P}{V_R}.$$

Accordingly, $\frac{V_R}{V_P} = \frac{1}{1 - \lambda_0}$.

From the equation (7), $$\frac{dV_R}{dV_P} = \frac{V_R}{V_P} = \frac{1}{1 - \lambda_0}. \tag{8}$$

Accordingly, by substituting the equation (8) into the equation (7), $$\begin{aligned} \frac{F_R - F_P}{F_P} &= \frac{M_R}{M_P} \cdot \frac{1}{1 - \lambda_0} \\ F_R - F_P &= F_P \cdot \frac{M_R}{M_P} \cdot \frac{1}{1 - \lambda_0} \\ F_R &= F_P\left(1 + \frac{M_R}{M_P} \cdot \frac{1}{1 - \lambda_0}\right) \\ &= \mu_1 \cdot M_R \cdot g \cdot \left(1 + \frac{M_R}{M_P} \cdot \frac{1}{1 - \lambda_0}\right) \\ \mu_1 &= \frac{F_R}{M_R \cdot g \cdot \left(1 + \frac{M_R}{M_P} \cdot \frac{1}{1 - \lambda_0}\right)} \\ &= \frac{F_R}{M_R \cdot g} \cdot \frac{1 - \lambda_0}{1 - \lambda_0 + \frac{M_R}{M_P}} = \frac{F_R}{M_R \cdot g} \cdot \frac{1 + \frac{M_R}{M_P} - \lambda_0 - \frac{M_R}{M_P}}{1 + \frac{M_R}{M_P} - \lambda_0} \\ &= \frac{F_R}{M_R \cdot g} \cdot \left(1 - \frac{\frac{M_R}{M_P}}{1 + \frac{M_R}{M_P} - \lambda_0}\right) \\ &= \frac{F_R}{M_R \cdot g} \cdot \left(1 - \frac{\frac{M_R}{M_P}}{1 + \frac{M_R}{M_P}} \cdot \frac{1 + \frac{M_R}{M_P}}{1 + \frac{M_R}{M_P} - \lambda_0}\right). \end{aligned} \tag{9}$$

In this way, the equation (9) agrees with the equation (7) described in Non-Patent Document 1.

Each block in a sheet carrying device in the document scanning apparatus 100 or the image forming apparatus 11 may be constituted by hardware logic or may be realized by software by using a CPU in the following manner.

That is, the sheet carrying device includes a CPU (central processing unit) that executes the order of a control program for realizing the aforesaid functions, ROM (read only memory) that stores the control program, RAM (random access memory) that develops the control program in an executable form, and a storage device (storage medium), such as memory, that stores the control program and various types of data therein. With this arrangement, the object of the present invention is realized by a predetermined storage medium. The storage medium stores, in a computer-readable manner, program codes (executable code program, intermediate code program, and source program) of the control program of the sheet carrying device of the present invention, which is software for realizing the aforesaid functions. The storage medium is provided to the sheet-carrying device. With this arrangement, the sheet-carrying device (alternatively, CPU or MPU) as a computer reads out and executes the program code stored in the storage medium provided.

The storage medium may be tape based, such as a magnetic tape or cassette tape; disc based, such as a magnetic disk including a Floppy® disc and hard disk and optical disk including CD-ROM, MO, MD, DVD, and CD-R; card based, such as an IC card (including a memory card) and an optical card; or a semiconductor memory, such as a mask ROM, an EPROM, an EEPROM, and a flash ROM.

Further, the sheet carrying device of the present invention may be arranged so as to be connectable to a communications network so that the program code is supplied to the sheet carrying device through the communications network. The communications network is not to be particularly limited. Examples of the communications network include the Internet, intranet, extranet, LAN, ISDN, VAN, CATV communications network, virtual private network, telephone network, mobile communications network, and satellite communications network. Further, a transmission medium that constitutes the communications network is not particularly limited. Examples of the transmission medium include (i) wired lines such as IEEE 1394, USB, power-line carrier, cable TV lines, telephone lines, and ADSL lines and (ii) wireless connections such as IrDA and remote control using infrared light, Bluetooth®, 802.11, HDR, mobile phone network, satellite connections, and terrestrial digital network. Note that the present invention can be also realized by the program codes in the form of a computer data signal embedded in a carrier wave which is embodied by electronic transmission.

As explained above, the sheet carrying device of the present invention may be arranged such that the slip detecting device includes: a sheet detecting device for detecting whether or not the sheet has reached a predetermined position on the carrying path; and a determining section for determining that a slip of the paper feeding roller occurs in an amount equal to or more than a predetermined amount when a delay of the sheet reaching the predetermined position is detected from a result of detection by the sheet detecting device after the paper feeding roller starts a sheet send-out operation.

The sheet carrying device may be arranged such that the control section counts up a total number of sheets carried by the paper feeding roller, and the control section controls the roller driving device so that the slip-settling operation is performed when the total number of sheets carried is not less than a predetermined number and that the slip-settling operation is not performed when the total number of sheets carried is less than the predetermined number.

According to the arrangement, the slip-settling operation is performed in a case where a total number of sheets carried by the paper feeding roller becomes equal to or more than a predetermined number of sheets. Until then, the slip-settling operation is not performed. That is to say, in a condition where the total number of sheets carried is less than the predetermined number of sheets, the paper feeding roller has few abrasion and contamination. Slipping of the paper feeding roller that occurs in such condition is accidental and temporary, and is not one which continuously occurs. Therefore, no slip-settling operations are taken for such slips. Thus, it is possible to prevent unnecessary control.

The sheet carrying device may be arranged so as to include: a sheet speed detecting device for detecting a travel speed of the sheet carried by the paper feeding roller; and a roller speed detecting device for detecting a carrying speed of the paper feeding roller in carrying the sheet, the control section (i) calculating a slip ratio from results of detection by the sheet speed detecting device and the roller speed detecting device, the slip ratio indicating a degree of a slip of the paper feeding roller in carrying the sheet, (ii) setting, in the slip-settling operation, a start-up acceleration of the paper feeding roller so that the start-up acceleration is lower as the slip ratio is higher, and (iii) controlling the roller driving device to rotate the paper feeding roller at the start-up acceleration thus set.

According to the arrangement, it is possible to set the start-up acceleration of the paper feeding roller based on a measured slip ratio. As a result, highly accurate control of the start-up acceleration of the paper feeding roller is possible.

The sheet carrying device may be arranged such that in the control section, the slip ratio employed in setting the start-up acceleration is an average value of slip ratios obtained by the paper feeding roller carrying a predetermined number of sheets.

According to the arrangement, the slip ratio employed in setting the start-up acceleration is an average value of slip ratios obtained by the paper feeding roller carrying a predetermined number of sheets. Therefore, the start-up acceleration is not easily affected by variations in the slip ratios calculated for individual sheet carrying. Thus, stable control of the start-up acceleration of the paper feeding roller is possible.

The sheet carrying device may be arranged such that in the control section, the slip ratio employed in setting the start-up acceleration is a slip ratio with highest frequency of appearance out of slip ratios obtained by the paper feed roller carrying a predetermined number of sheets.

According to the arrangement, the slip ratio employed in setting the start-up acceleration is a slip ratio with highest frequency of appearance out of slip ratios obtained by the paper feeding roller carrying a predetermined number of sheets. Therefore, the start-up acceleration is not easily affected by variations in the slip ratios calculated for individual sheet carrying. Thus, stable control of the start-up acceleration of the paper feeding roller is possible.

The sheet carrying device may further include a sheet size detecting device for detecting a size of a sheet on the sheet mounting tray, the control section calculating the slip ratio for each size detected by the sheet size detecting device.

According to the arrangement, the slip ratio of the paper feeding roller for each sheet size is calculated. This allows setting of the start-up acceleration of the paper feeding roller for each sheet size. Thus, it is possible to favorably control the start-up acceleration of the paper feeding roller according to the sheet size.

The sheet carrying device may be arranged such that when the slip detecting device detects that a slip of the paper feeding roller occurs, the control section controls the roller driving device so as to (i) once stop the paper feeding roller and (ii) subsequently restart rotating the paper feeding roller at a start-up acceleration a previous start-up acceleration of the paper feeding roller.

According to the arrangement, when a slip has occurred on the paper feeding roller, the paper feeding roller once stops, and subsequently restarts to rotate. In this case, the start-up acceleration from the restart of the rotation to a time when the paper feeding roller reaches a predetermined speed is lower than the previous start-up acceleration. Therefore, in a case where a slip of the paper feeding roller on a sheet occurs, for example, the slip caused by abrasion or contamination of the paper feeding roller, it is possible to prevent the slip so that the sheet can be reliably sent out from a sheet mounting tray by the paper feeding roller.

According to the present invention, in a case where a slip of the paper feeding roller on a sheet occurs, for example, the slip caused by abrasion or contamination of the paper feeding roller, it is possible to prevent the slip so that the sheet can be reliably sent out from a sheet mounting tray by the paper feeding roller. In this case, the paper feeding roller has a lower start-up acceleration before the paper feeding roller reaches a predetermined speed. However, because the maximum speed (predetermined speed) is maintained after the start-up, a decrease in a sheet carrying speed can be prevented. That is, according to the present invention, even in a case where the paper feeding roller slips on a sheet, the sheet can be reliably carried. Concurrently, by preventing the decrease in the sheet carrying speed, a speed of processes that includes the sheet carrying can be prevented from decreasing.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A sheet carrying device comprising:

a paper feeding roller for sending out a sheet to a carrying path one by one from a sheet mounting tray;

a roller driving device for rotating the paper feeding roller; and a control section for controlling the roller driving device to rotate the paper feeding roller, the sheet carrying device including a slip detecting device for detecting whether or not a slip of the paper feeding roller occurs in an amount equal to or more than a predetermined amount when the sheet is carried, the control section controlling the roller driving device so as to perform a slip-settling operation which decreases a start-up acceleration of the paper feeding roller when the slip detecting device detects that a slip of the paper feeding roller occurs in an amount equal to or more than the predetermined amount, the start-up acceleration being an acceleration from a time when the paper feeding roller starts to rotate to a time when the paper feeding roller reaches a predetermined speed, and wherein the control section counts up a total number of sheets carried by the paper feeding roller, and the control section controls the roller driving device so that the slip-settling operation is performed when the total number of sheets carried is not less than a predetermined number and that the slip-settling operation is not performed when the total number of sheets carried is less than the predetermined number.

2. The sheet carrying device as set forth in claim 1, wherein the slip detecting device includes:

a sheet detecting device for detecting whether or not the sheet has reached a predetermined position on the carrying path; and a determining section for determining that a slip of the paper feeding roller occurs in an amount equal to or more than a predetermined amount when a delay of the sheet reaching the predetermined position is detected from a result of detection by the sheet detecting device after the paper feeding roller starts a sheet send-out operation.

3. A sheet carrying device comprising:

a paper feeding roller for sending out a sheet to a carrying path one by one from a sheet mounting tray;

a roller driving device for rotating the paper feeding roller; and a control section for controlling the roller driving device to rotate the paper feeding roller, the sheet carrying device including a slip detecting device for detecting whether or not a slip of the paper feeding roller occurs in an amount equal to or more than a predetermined amount when the sheet is carried, the control section controlling the roller driving device so as to perform a slip-settling operation which decreases a start-up acceleration of the paper feeding roller when the slip detecting device detects that a slip of the paper feeding roller occurs in an amount equal to or more than the predetermined amount, the start-up acceleration being an acceleration from a time when the paper feeding roller starts to rotate to a time when the paper feeding roller reaches a predetermined speed, a sheet speed detecting device for detecting a travel speed of the sheet carried by the paper feeding roller; and a roller speed detecting device for detecting a carrying speed of the paper feeding roller in carrying the sheet, the control section (i) calculating a slip ratio from results of detection by the sheet speed detecting device and the roller speed detecting device, the slip ratio indicating a degree of a slip of the paper feeding roller in carrying the sheet, (ii) setting, in the slip-settling operation, a start-up acceleration of the paper feeding roller so that the start-up acceleration is lower as the slip ratio is higher, and (iii) controlling the roller driving device to rotate the paper feeding roller at the start-up acceleration thus set.

4. The sheet carrying device as set forth in claim 3, wherein in the control section, the slip ratio employed in setting the start-up acceleration is an average value of slip ratios obtained by the paper feeding roller carrying a predetermined number of sheets.

5. The sheet carrying device as set forth in claim 3, wherein in the control section, the slip ratio employed in setting the start-up acceleration is a slip ratio with highest frequency of appearance out of slip ratios obtained by the paper feed roller carrying a predetermined number of sheets.

6. The sheet carrying device as set forth in claim 3, further comprising:

a sheet size detecting device for detecting a size of a sheet on the sheet mounting tray, the control section calculating the slip ratio for each size detected by the sheet size detecting device.

7. The sheet carrying device as set forth in claim 1, wherein:

when the slip detecting device detects that a slip of the paper feeding roller occurs, the control section controls the roller driving device so as to (i) once stop the paper feeding roller and (ii) subsequently restart rotating the paper feeding roller at a start-up acceleration lower than a previous start-up acceleration of the paper feeding roller.

8. A document carrying device comprising a sheet carrying device as set forth in claim 1, the document carrying device carrying a document as a sheet by use of the sheet carrying device.

9. An image forming apparatus comprising:

a sheet carrying device as set forth in claim 1; and an image forming section for performing printing on paper, the sheet carrying device carrying paper as a sheet to the image forming section.

10. A sheet carrying method for sending out a sheet to a carrying path one by one from a sheet mounting tray by a paper feeding roller, the method comprising:

performing a slip-settling operation for decreasing a start-up acceleration of the paper feeding roller when a slip of the paper feeding roller occurs in an amount equal to or more than a predetermined amount in carrying the document, the start-up acceleration being an acceleration from a time when the paper feeding roller starts to rotate to a time when the paper feeding roller reaches a predetermined speed, and counting up a total number of sheets carried by the paper feeding roller so that the slip-settling operation is performed when the total number of sheets carried is not less than a predetermined number and that the slip-settling operation is not performed when the total number of sheets carried is less than the predetermined number.

11. A sheet carrying method for sending out a sheet to a carrying path one by one from a sheet mounting tray by a paper feeding roller, the method comprising:

performing a slip-settling operation for decreasing a start-up acceleration of the paper feeding roller when a slip of the paper feeding roller occurs in an amount equal to or more than a predetermined amount in carrying the document, the start-up acceleration being an acceleration from a time when the paper feeding roller starts to rotate to a time when the paper feeding roller reaches a predetermined speed, wherein the slip-settling operation comprises detecting a travel speed of the sheet carried by the paper feeding roller;

detecting a carrying speed of the paper feeding roller in carrying the sheet, and controlling the slip-settling operation by (i) calculating a slip ratio from results of detecting the travel speed of the sheet and the carrying speed of the paper feeder roller, the slip ratio indicating a degree of a slip of the paper feeding roller in carrying the sheet, (ii) setting, in the slip-settling operation, a start-up acceleration of the paper feeding roller so that the start-up acceleration is lower as the slip ratio is higher, and (iii) rotating the paper feeding roller at the start-up acceleration thus set.

* * * * *